US006086193A

United States Patent [19]

Shimada et al.

[11] Patent Number: 6,086,193

[45] Date of Patent: Jul. 11, 2000

[54] INK CARTRIDGE AND A PRINTING DEVICE USING THE INK CARTRIDGE

[75] Inventors: Kazumichi Shimada; Takao Kobayashi; Hisashi Miyazawa, all of Nagano, Japan

[73] Assignee: Seiko Epson Corporation, Tokyo, Japan

[21] Appl. No.: 08/905,457

[22] Filed: Aug. 4, 1997

[30] Foreign Application Priority Data

| | | | |
|---|---|---|---|
| Aug. 2, 1996 | [JP] | Japan | 8-220656 |
| Aug. 13, 1996 | [JP] | Japan | 8-231504 |
| Aug. 28, 1996 | [JP] | Japan | 8-247294 |

[51] Int. Cl.[7] ..... B41J 2/175

[52] U.S. Cl. ..... 347/86

[58] Field of Search ..... 347/43, 85, 86, 347/87, 100

[56] References Cited

U.S. PATENT DOCUMENTS

| | | | |
|---|---|---|---|
| 4,533,923 | 8/1985 | Suzuki | 347/15 |
| 4,672,432 | 6/1987 | Sakurada et al. | 347/15 |
| 4,714,936 | 12/1987 | Helinski et al. | 347/43 |
| 5,602,574 | 2/1997 | Williams | 347/43 |
| 5,731,825 | 3/1998 | Danzuka et al. | 347/15 |
| 5,742,306 | 4/1998 | Gompertz et al. | 347/43 |
| 5,790,158 | 8/1998 | Shinada et al. | 347/86 |

FOREIGN PATENT DOCUMENTS

| | | |
|---|---|---|
| 0 639 462 | 2/1995 | European Pat. Off. . |
| 0 665 108 | 8/1995 | European Pat. Off. . |
| 0 748 692 | 12/1995 | European Pat. Off. . |
| 0 699 533 | 6/1996 | European Pat. Off. . |
| 27 750 076 | 12/1997 | France . |
| 34 08 545 | 9/1984 | Germany . |
| 3 415 778 | 10/1984 | Germany . |
| 34 01 071 | 7/1985 | Germany . |
| 195 34 577 | 3/1996 | Germany . |
| 195 40 472 | 5/1996 | Germany . |
| 1 972 7091 | 1/1998 | Germany . |
| 61-108254 | 5/1986 | Japan . |
| 2 301 064 | 11/1996 | United Kingdom . |
| 2 314 809 | 1/1998 | United Kingdom . |

*Primary Examiner*—N. Le
*Assistant Examiner*—Thinh Nguyen
*Attorney, Agent, or Firm*—Stroock & Stroock & Lavan LLP

[57] ABSTRACT

One of ink chambers 102 of an ink cartridge 70 has a larger volume. The color ink having the largest lightness value is stored in this ink chamber. For the amounts vc1, vc2, vm1 and vm2 of light and deep cyan and magenta inks contained in the ink chambers thereof, the amount vy of the ink having the largest lightness value contained in the cartridge thereof, or the yellow, is defined as:

vy<vc1+vc2, and vy<vm1+vm2;

Vc1<vy<Vc1+vc2, and Vm1<vy<vm1+vm2.

When a natural picture or a graph painted with different monocolors are actually printed, those color inks are substantially uniformly used. There is no case where one ink is used up earlier than the remaining ones, and the color ink cartridge 70*b* must be replaced with a new one in a state that large amounts of the remaining inks are still left.

6 Claims, 29 Drawing Sheets

FIG.16

GRADIENTS AND AMOUNTS OF INKS

| | | C1 | C2 | M1 | M2 | Y | Bk |
|---|---|---|---|---|---|---|---|
| DYE | DIRECTBLUE199 | 3.6 | 0.9 | | | | |
| | ACIDRED289 | | | 2.8 | 0.7 | | |
| | DIRECTYELLOW86 | | | | | 1.8 | |
| | FOODBLACK2 | | | | | | 4.8 |
| DIETHYLENE GLYCOL | | 30 | 35 | 20 | 25 | 30 | 25 |
| SURFYNOL465 | | 1 | 1 | 1 | 1 | 1 | 1 |
| WATER | | 65.4 | 63.1 | 76.2 | 73.3 | 67.2 | 69.2 |
| VISCOSITY (mPa · s) | | 3.0 | 3.0 | 3.0 | 3.0 | 3.0 | 3.0 |
| AMOUNTS OF INKS (cc) | | 20 | 20 | 20 | 20 | 28 | 56 |

γ CORRECTION DATA

RELATIONSHIPS AFTER Γ-CORRECTION

FIG.30

| NO. | PATTERN (I) DOT | | INK SURROUNDING DOTS | | PATTERNS REJECTED BY SIGNAL PROCESSING (II) | GRAININESS RESULTS (III) | COLOR ORDERS ALLOWING PATTERNS TO EXIST (IV) | | |
|---|---|---|---|---|---|---|---|---|---|
| 1 | C1 | 2ND | M1 | 1ST | | ×(BAD, NOT NEGLECTIBLE) | M1C1M2C2 | M1M2C1C2 | |
| 2 | C1 | 2ND | M2 | 1ST | | | M1M2C1C2 | | |
| 3 | M1 | 2ND | C2 | 1ST | | | C1C2M1M2 | | |
| 4 | M1 | 2ND | C1 | 1ST | | | C1M1C2M2 | C1C2M1M2 | |
| 5 | C2 | 2ND | M1 | 1ST | | | C1M1C2M2 | M1C1M2C2 | M1M2C1C2 |
| 6 | C1 | 1ST | M1 | 2ND | | | C1M1C2M2 | C1C2M1M2 | |
| 7 | C1 | 1ST | M2 | 2ND | | | C1M1C2M2 | M1C1M2C2 | C1C2M1M2 |
| 8 | C2 | 2ND | M2 | 1ST | | | M1C1M2C2 | M1M2C1C2 | |
| 9 | M1 | 1ST | C2 | 2ND | | | C1M1C2M2 | M1C1M2C2 | M1M2C1C2 |
| 10 | M2 | 2ND | C2 | 1ST | | | C1M1C2M2 | C1C2M1M2 | |
| 11 | M1 | 1ST | C1 | 2ND | | | M1C1M2C2 | M1M2C1C2 | |
| 12 | C2 | 1ST | M2 | 2ND | | | C1M1C2M2 | C1C2M1M2 | |
| 13 | C2 | 1ST | M1 | 2ND | | | C1C2M1M2 | | |
| 14 | M2 | 2ND | C1 | 1ST | | | C1M1C2M2 | M1C1M2C2 | C1C2M1M2 |
| 15 | M2 | 1ST | C2 | 2ND | | | M1C1M2C2 | M1M2C1C2 | |
| 16 | M2 | 1ST | C1 | 2ND | | ○(GOOD, NEGLECTIBLE) | M1M2C1C2 | | |

C1: DEEP CYAN, C2: LIGHT CYAN, M1: DEEP MAGENTA, M2: LIGHT MAGENTA,
1ST: PRIOR PRINTING, AND 2ND: SUBSEQUENT PRINTING

FIG.31

| INK COLOR | DENSITY | AMOUNTS |
|---|---|---|
| MAGENTA | HIGH M1 | 8 |
| | MIDDLE M2 | 12 |
| | LOW M3 | 16 |
| CYAN | HIGH C1 | 8 |
| | MIDDLE C2 | 12 |
| | LOW C3 | 16 |
| YELLOW | HIGH Y1 | 10 |
| | LOW Y2 | 14 |

INK CARTRIDGE AND A PRINTING DEVICE USING THE INK CARTRIDGE

BACKGROUND OF THE INVENTION

Field of the Invention

The present invention relates to an ink cartridge containing a plural number of inks, and a printing device using the ink cartridge.

A color printer of the type in which inks of different colors are ejected from a head has prevailed for an output device of a computer. In printing a multi-color image by using three color inks of cyan, magenta and yellow (C, M, Y), some methods are available for the formation of a multi-tone image. One method is employed for the conventional printers. In this method, the size of a dot formed on a sheet of paper by an ink droplet or droplet ejected at once is fixed, and a tone of an image to be printed is expressed in terms of a density of dots (frequency of occurrence of dots per unit area). In another method, a density of an image per unit area is varied by adjusting the diameters of dots printed on the paper. Recently, a fine fabrication technique to fabricate a head for ejecting ink droplets advances, and a density of dots that can be formed within a given length and a range within which the dot diameter may be varied are increased and broadened year by year. However, in the field of printers, a print density (resolution) is at most 300 dpi to 720 dpi, and the diameter of ink droplets is in the order of several tens microns. These figures show that an expression ability of the printer is much inferior to that of a silver-salt photograph (its resolution is several tens dpi on the film).

In a region where an image density is low or a density of dots to be printed is low, dots are sparsely formed (called grained), and this is unpleasant to the eye. To cope with this, a printing device using light and deep color inks and a printing method using the same were proposed. In the proposal, inks of high and low color densities are used for each color, and the ejection of those inks are controlled, whereby a print excellent in tone expression is realized. A recording method for recording a multi-tone image and a device for executing the method are disclosed in Japanese Patent Laid-Open Publication No. Sho. 61-108254. In the publication, a head for forming light and deep color dots for each color is provided. The number of light and deep dots formed within a given dot matrix and an overlapping of those dots are controlled in accordance with density information of an input image, whereby a multi-tone image is recorded.

A plural number of inks must be used for realizing the multi-color printing or multi-tone image printing. Those inks may be supplied from a plural number of ink tanks, respectively. In this case, the amounts of inks left in the tanks must be managed individually, and the piping from the ink tanks to the print head is complicated. To avoid those, the plural number of inks are stored in a single ink cartridge.

In the printing device using the plural number of inks, unsatisfactory study has been made on the proper amounts of the inks contained in the ink cartridge. Recently, to an easy handling, a plural number of inks are stored in a single ink cartridge, and those inks are all replaced with new ones. In this method, when any of the inks is used up, the whole cartridge is replaced with a new one. Thus, unless the amounts of light and deep color inks for each color contained in the ink cartridge are properly determined, the inks other than the ink completely used up must be discarded, and this is wasteful. Accordingly, an object of the present invention is to obtain a proper relationship among the amounts of inks contained in the ink chambers of an ink cartridge.

Where the different amounts of inks are stored in the ink chambers of the ink cartridge, the ink chambers are also different in size, usually, and various problems arise. If the volumes of the ink chambers differ every ink, great difficulties arise in the design of the print head, usually, disposed right under the ink chambers, as well as its printing control. The difficulties will be described in detail. In a printer in which a print head is integrally mounted on a carriage on which an ink cartridge is put, an image is printed while moving the carriage in the widthwise direction of the paper (referred to a main scan direction). It is supposed that at least three ink chambers are arrayed on the ink cartridge in the main scan direction, and printing nozzles are located right under the ink chambers. If the widths (in the main scan direction) of the ink chambers are different with the different volumes of the ink chambers, the nozzle intervals are also different. If a plural number of ink droplets are applied to a position on the paper to form a dot thereat while moving the carriage, it is necessary to individually control the timings of forming the ink droplets for each ink.

In a case where a plural number of inks are stored in a single ink cartridge, when the cartridge is set to the carriage, a plural number of ink supply needles are concurrently inserted into the ink cartridge. This makes it difficult to secure a sufficient sealing at the time of inserting the needles. A plural number of ink supply ports must be provided within a limited space in association with the plural number of ink chambers. Therefore, it is difficult to secure a sufficient deflection of the sealing means, which is mounted on the ink supply ports, in the diameter direction. Accordingly, a slight position shift that may occur at the time of mounting the ink cartridge will deteriorate the sealing performance or damage the ink supply needles. In a case where the different volumes of the ink chambers entails the unequal intervals among the ink supply ports, the sealing problem is more distinguished when comparing with the case where the ink supply ports are equidistantly arrayed. When the intervals among the ink supply ports are different, and as a result, the intervals among the ink supply needles or the intervals among the ink supply ports are varied, strain is frequently concentrated at specific locations.

Accordingly, another object of the present invention is to secure sufficient sealing at the ink supply ports of the ink cartridge including a plural number of ink chambers.

An ink cartridge is invented to achieve at least part of the objects. A printing device using the ink cartridge is invented. The ink cartridge and the printing device of the invention will be described hereunder.

A first ink cartridge of the invention is an ink cartridge containing inks for printer wherein at least three ink chambers for containing inks are formed by partitioning the inner space of the ink cartridge, the volume of one ink chamber being different from the volumes of the remaining ones, and ink supply ports communicatively connected to the ink chambers by way of ink passages are arrayed on the bottom of a main body of the ink cartridge in association with the ink chambers, respectively.

The ink cartridge is provided with at least three ink chambers for containing different inks, and the volume of one ink chamber is different from the volumes of the remaining ones. Ink supply ports communicatively connected to the ink chambers by way of ink passages are arrayed on the bottom of a main body of the ink cartridge in association with the ink chambers, respectively. The ink cartridge has an advantage of an easy ink supply although its structure includes the ink chambers of the different volumes containing a plural number of inks.

The unique feature of the ink supply ports being equidistantly arrayed in a given direction, is very useful in the print head control. Specifically, if the ink supply ports are equidistantly arrayed, the ink ejecting positions are also equidistantly spaced from one another, usually. Accordingly, the control of the timings of ink ejection is also easy.

In the ink cartridge, the ink chambers of three or more are arranged in the direction of transporting the ink cartridge, the difference of the volume of the one ink chamber from those of the remaining ones is realized by the width difference of the one ink chamber, and the given direction in which the ink supply ports are arrayed is the ink cartridge transporting direction. By realizing the difference of the volume of the one ink chamber by the width difference of the one ink chamber, a space required for placing the transported ink cartridge within the printing device can be considerably reduced.

The ink chamber of the different volume, or the volume different from those of the remaining ones, is preferably located at the end of the ink cartridge. By so doing, the ink passages derived from the ink chambers are reduced in length as a whole. The ink chamber of the different volume may contain yellow ink. The yellow ink provides the least graininess when the dots are formed by it. Further, its color density may be set at a desired value, and the volume of the chamber-contained yellow ink may be varied relatively freely.

The ink chambers are five in number and contain magenta ink, light magenta ink whose color density is lower than magenta, cyan ink, light cyan ink whose color density is lower than cyan, and yellow ink, and the ink chamber containing yellow ink may be s located at the trailing end of the series of the ink chambers when viewed in the cartridge transporting direction. Normally, the positions of the ink chambers in the ink cartridge are related to the printing positions of the print head in one-to-one correspondence. Therefore, the ink located at the trailing end is last ejected to form a dot when the ink cartridge is moved. There is a chance that the ink to form dot later spreads into the ink to form a dot early. However, the yellow ink increases a graininess if it spreads and the diameter of a dot formed thereby increases.

The ink chambers are arranged in the order of the cyan ink chamber, light cyan ink chamber, magenta ink chamber, light magenta ink chamber, and yellow ink chamber when viewed in the cartridge transporting direction. By so arranging, if the ink later ejected spreads and a dot formed by it increases its diameter, there is no increase of a graininess of the resultant image.

In the ink cartridge, the ink supply ports includes each a cylindrical fitting part fit to the inner surface of the ink supply port, a thin, cylindrical flexible part extended from the fitting part toward the ink chamber associated therewith while being substantially parallel to the fitting part, and an elastic sealing part being extended upward from the flexible part while being protruded inward, the elastic sealing part liquid tightly receiving an ink supply needle to be inserted into the ink supply port associated therewith. With such a structure, even when a plural number of the ink supply ports are disposed within a limited space, the thin, flexible part extended from the fitting part toward the ink chamber associated therewith while being substantially parallel to the fitting part, operates to thereby ensure a reliable sealing.

A tapered guide surface for guiding the ink supply needle is provided ranging from the bottom-of the fitting part to the flexible part. The unique feature enables the ink cartridge to smoothly be loaded into the carriage. The elastic sealing part is preferably formed protruding from the inner surface of the flexible part through the tapered guide surface for guiding the ink supply needle. When both are formed into a unit, a limited space may be efficiently used.

In the ink cartridge, the ink chambers of three or more are partitioned by partitioning walls, a lid is provided covering the openings of the ink chambers, the chambers having the openings formed in the sides thereof closer to the ink supply ports, a plural number of reinforcing horizontal ribs are raised from the inner surface of the lid while being extended in the longitudinal direction of the ink chambers and located corresponding to the ink chambers, a part of each of the ribs closer to each of the ink supply ports being higher than the remaining part thereof. With such a structure, a strength of the ink cartridge is improved. Therefore, the ink cartridge can be transported without any deformation and any leakage of ink from the fitting parts of the ink supply ports.

The kinds of inks contained in the ink chambers of three or more of the ink cartridge and the amounts (volume) of the chamber-contained inks are correlatively defined as follows: the ink chambers of three or more contain the whole or independently at least some of m (m: natural number of 2 or larger) kinds of light and deep color inks X1, X2, . . . , Xm for each hue, and n (n: natural number of 1 or larger) kinds of color inks Y1, . . . , Yn whose lightness values are larger than that of each of the color inks X1, X2, . . . , Xm for the same recording rate, and the amounts vxk ($1 \leqq k \leqq m$) of the m kinds of chamber-contained color inks and the amounts vyi ($1 \leqq i \leqq n$) of the n kinds of color inks having large lightness values satisfy the following relation $$\sum_{i=1}^{n} vyi < \sum_{k=1}^{m} vxk$$

and the amount of the deepest color ink, chamber-contained, of the n kinds of color inks having the large lightness values is larger than the amount of the deepest color ink, chamber-contained, of the m kinds of color inks.

In the ink cartridge, the total sum of the amounts of the inks having a high lightnes for the same-recording rate is smaller than that of the inks of another hue. When the amount of chamber-contained ink having the highest color density in one hue is compared with the corresponding one in the other hue, the amount of chamber-contained ink of the highest color density of the n kinds of the inks of large lightness values is larger than the amount of chamber-contained ink of the highest color density of the m kinds of light and deep color inks. If the amounts of both the inks are so selected, proper amounts of the chamber-contained inks in the ink cartridge are set up for the amounts of the inks consumed in the ink cartridge of the printing device that prints a multi-tone image. Thus, the amounts of inks stored in the ink chambers are selected as described above, the waste of all the inks in the ink cartridge are reduced for a variation of the amounts of the consumed inks.

The color ink whose lightness value is larger than of the remaining color inks may be yellow ink. A color printing by using inks of three colors, cyan, magenta and yellow may be imagined for such a case. Of those three color inks, the yellow ink is the highest in lightness value. The kinds of the color inks having large values may be reduced in number when comparing to the remaining ones. It is practical that the amount of consumed yellow ink is increased by the reduced number of ink kinds with respect to the amount of deep color ink of the two or more kinds of light and deep color inks. This results in that in the printing device using the inks of the primary colors, cyan, magenta and yellow, the ink cartridge stores the cyan and magenta inks each consisting of at least two kinds of color inks for m kinds of light and deep color inks, and the color ink consisting of only yellow color in for n kinds of color inks.

The amounts of the m kinds of light and deep color inks contained in the ink chambers thereof and the amounts of the n kinds of color inks contained in the ink chambers thereof may be determined in consideration with γ-characteristics of the color inks.

In the ink cartridge of the invention, the ink chambers of three or more contain the whole or independently at least some of m (m: natural number of 2 or larger) kinds of light and deep color inks X1, X2, . . . , Xm (the inks become thin in color density in this order) for each hue, and n (n: natural number of 1 or larger) kinds of color inks Y1, . . . , Yn (the inks become thin in color density in this order) whose lightness values are larger than that of each of the color inks X1, X2, . . . , Xm for the same recording rate, and the amounts vxk ($1 \leqq k \leqq m$) of the m kinds of color inks contained in the ink chambers thereof and the amounts vyi ($1 \leqq i \leqq n$) of the n kinds of color inks having large lightness values contained in the ink chambers thereof satisfy the following relation $$vxi < vyi \text{ (i: integer between 1 and n).}$$

In the ink cartridge, the amounts of the m kinds of color inks contained in the ink chambers thereof and the amounts of the n kinds of color inks having large lightness values contained in the ink chambers are correlatively defined as just mentioned. To be more specific, let us consider a case where the consumed inks are the inks of the primary colors, cyan, magenta and yellow, and where for each of the cyan and magenta, two kinds of color inks, or light and deep color inks are used, and for the yellow, one kind of color ink is used. In this case, the amount of chamber-contained yellow ink is larger than that of the cyan or magenta ink, as taught by the relation of the amounts of ink-chambered or tank contained inks as stated above. By so selecting the amounts of the ink-chamber contained inks, there is no chance that the amounts of the i-th inks, consumed, of the m kinds of light and deep color inks are each greatly different from the amount of the i-th ink, consumed, of the n kinds of the inks of high lightness. Therefore, proper amounts of the inks are contained in the ink cartridge used by a printing device for printing a multi-tone image. Consequently, the amounts of color inks of different colors and color densities contained in the ink chambers are saved as a whole.

If $vyi \leqq 1.5 \cdot vxi$ (i: integer between 1 and n), it never happens that the amount of the i-th ink, consumed, of the n kinds of the inks of high lightness is greatly different from the amounts of the i-th inks, consumed, of the m kinds of light and deep color inks.

Further, in the ink cartridge, the relation may be defined by $vyi \leqq 1.5 \cdot vxi$. In this case, the following relation holds $$vxi < vyi \leqq 1.5 \cdot vxi.$$

The useless consumption of the inks is reduced as a whole.

Also in this case, in the printing by the primary colors, cyan, magenta and yellow inks may be used. Actually, the ink cartridge stores the cyan and magenta inks each consisting of at least two kinds of color inks for m kinds of light and deep color inks, and the color ink consisting of only yellow color in for n kinds of color inks. The amounts of the m kinds of light and deep color inks contained in the ink chambers thereof and the amounts of the n kinds of color inks contained in the ink chambers thereof may be determined in consideration with γ-characteristics of the color inks.

The ink cartridge may be defined such that the ink chambers of three or more contain the whole or independently at least some of m (m: natural number of 2 or larger) kinds of light and deep color inks X1, X2, . . . , Xm (the inks become thin in color density in this order) for each hue, and n (n: natural number of 1 or larger) kinds of color inks Y1, . . . , Yn (the inks become thin in color density in this order) whose lightness values are larger than of the color inks X1, X2, . . . , Xm for the same recording rate, and the amounts vxk ($1 \leqq k \leqq m$) of the m kinds of color inks contained in the ink chambers thereof and the amounts vyi ($1 \leqq i \leqq n$) of the n kinds of color inks having large lightness values contained in the ink chambers thereof satisfy the following relations, $$\sum_{i=1}^{n} vyi < \sum_{k=1}^{m} vxk \quad (n < m)$$

and $$vxi < vyi < vxi + vxi + 1 \text{ (i: integer between 1 and (n−1)).}$$

In the ink cartridge, the total sum of the amounts of the inks having a high lightness for the same recording rate is smaller than that of the inks of another hue. When comparing the amounts of color inks of color densities with one another, the amount of chamber-contained ink having a color density of the n kinds of color inks having a high lightness is larger than the amounts of the chamber-contained inks having the higher color density of the m kinds of color inks, but is smaller than the total sum of the inks having the lower color density to the amount of ink. To be more specific, let us consider a case where the consumed inks are the inks of the primary colors, cyan, magenta and yellow, and where for each of the cyan and magenta, three kinds of color inks, or light, medium and deep color inks are used, and for the yellow, two kinds of color inks, or light and deep yellow inks, are used. In this case, the total amount of two chamber-contained yellow inks is smaller than that the total amount of three cyan or magenta inks, and the amount of the yellow of high color density is larger than of the magenta or cyan ink of the highest color density, but smaller than the sum of the amount of magenta or cyan ink of the highest color density and the amount of magenta or cyan ink whose color density is next to the former. Further, the amount of yellow ink of low color density is larger than of the cyan or magenta ink of a medium color density, but smaller than the sum of the amount of cyan or magenta ink of the medium color density and the amount of cyan or magenta ink whose color density is next to the former. By so selecting the amounts of both the inks contained in the ink chambers thereof, a great difference is not created between the amounts of the inks stored in the ink cartridge, and proper amounts of the inks are contained in the ink cartridge used by a printing device for printing a multi-tone image. In this case, the unnecessary waste of the inks is further reduced.

In the ink cartridge, the ink chambers are six in number and contain black ink, deep cyan ink, light cyan ink, deep magenta ink, light magenta ink, and yellow ink, and the six ink supply ports provided in association with the six ink chambers are linearly arrayed in the direction of transporting the ink cartridge, the ink supply ports being arrayed in the order of black, deep cyan, light cyan, deep magenta, light magenta, and yellow. This order is determined in consideration with the spreading of inks. The light and deep cyan inks whose graininess is easy to grow are ejected earlier than the remaining one to form dots. As a result, it never happens that the cyan dots are formed in an area formed by another color ink already ejected (the area is still wet), and the dot area grows to increase a graininess.

In addition to the ink cartridge described above, a printing device using the ink cartridge was invented on the basis of the same technical concept as of the ink cartridge. In this respect, it is believed that the combination of the printing device and the ink cartridge satisfies the requirement of the singleness of the invention.

The printing device has a head for ejecting at least two kinds of light and deep color inks and a color ink whose lightness value is larger than the light and deep color inks for the same recording rate, the printing device printing an image in the form of a distribution of dots by the color inks. The printing device comprises:

- an ink cartridge including ink chambers for containing inks are respectively formed for the color inks by partitioning the inner space of the ink cartridge, the volume of the ink chamber containing the color ink whose lightness value being larger than of the light and deep color inks for the same recording rate;
- input means for inputting a tone signal of an image to be formed;
- dot-formation determining means for determining the formation of dots by the m kinds of light and deep color inks for each hue and the ink having the larger lightness value in accordance with input tone signal; and
- head drive means for causing the color inks contained in the ink chambers of the ink cartridge to eject from the head by controlling the head in accordance with the result of the dot formation determined by the dot-formation determining means.

The printing device is provided with an ink cartridge having ink chambers containing two or more kinds of color inks of different color densities and color ink whose lightness is higher than of the two or more kinds of color inks for a recording rate. The volume of the ink chamber containing the ink whose lightness is higher than of the two or more kinds of color inks for a recording rate is larger than that of each of the ink chambers containing the remaining inks. If the total amount of consumed ink of higher lightness is smaller than the total amount of two or more kinds of the consumed inks of different color densities, proper amounts of the inks may be left in the ink chambers of the ink cartridge.

In the printing device, the ink cartridge contains the whole or independently at least some of m (m: natural number of 2 or larger) kinds of light and deep color inks X1, X2, . . . , Xm for each hue, and n (n: natural number of 1 or larger) kinds of color inks Y1, . . . , Yn whose lightness values are larger than of the color inks X1, X2, . . . , Xm for the same recording rate, and the amounts vxk ($1 \leqq k \leqq m$) of the m kinds of color inks contained in the ink chambers thereof and the amounts vyi ($1 \leqq i \leqq n$) of the n kinds of color inks having large lightness values contained in the chambers thereof satisfy the following relation, $$\sum_{i=1}^{n} vyi < \sum_{k=1}^{m} vxk \quad (n < m)$$

and the amount of the deepest color ink, chamber-contained, of the n kinds of color inks having the large lightness values is larger than the amount of the deepest color ink, chamber-contained, of the m kinds of color inks.

In the printing device, the total sum of the amounts of the inks having a high lightness for the same recording rate is smaller than that of the inks of another hue. When the amount of chamber-contained ink having the highest color density in one hue is compared with the corresponding one in the other hue, the amount of chamber-contained ink of the highest color density of the n kinds of the inks of large lightness values is larger than the amount of chamber-contained ink of the highest color density of the m kinds of light and deep color inks. If the amounts of both the inks are so selected, proper amounts of the chamber-contained inks in the ink cartridge are set up with respect to the amounts of the inks consumed by the printing device that prints a multi-tone image.

In the printing device, the ink cartridge contains the whole or independently at least some of m (m: natural number of 2 or larger) kinds of light and deep color inks X1, X2, . . . , Xm (the inks become thin in color density in this order) for each hue, and n (n: natural number of 1 or larger) kinds of color inks Y1, . . . , Yn (the inks become thin in color density in this order) whose lightness values are larger than of the color inks X1, X2, . . . , Xm for the same recording rate, and the amounts vxk ($1 \leqq k \leqq m$) of the m kinds of color inks contained in the ink chambers thereof and the amounts vyi ($1 \leqq i \leqq n$) of the n kinds of color inks having large lightness values satisfy the following relation $vxi < vyi$ (i: integer between 1 and n).

In the printing device, the amounts of the m kinds of color inks contained in the ink chambers thereof and the amounts of the n kinds of color inks having large lightness values contained in the ink chambers are correlatively defined as just mentioned. To be more specific, let us consider a case where the consumed inks are the inks of the primary colors, cyan, magenta and yellow, and where for each of the cyan and magenta, two kinds of color inks, or light and deep color inks are used, and for the yellow, one kind of color ink is used. In this case, the amount of chamber-contained yellow ink is larger than that of the cyan or magenta ink, as taught by the relation of the amounts of ink-chambered or tank contained inks as stated above. By so selecting the amounts of the ink-chamber contained inks, there is no chance that the amounts of the i-th inks, consumed, of the m kinds of light and deep color inks are each greatly different from the amount of the i-th ink, consumed, of the n kinds of the inks of high lightness. Therefore, proper amounts of the inks are contained in the ink cartridge with respect to the amounts of inks used by a printing device for printing a multi-tone image.

If $vyi \leqq 1.5 \cdot vxi$ (i: integer between 1 and n), it never happens that the amount of the i-th ink, consumed, of the n kinds of the inks of high lightness is greatly different from the amounts of the i-th inks, consumed, of the m kinds of light and deep color inks.

In the printing device, the ink cartridge contains the whole or independently at least some of m (m: natural number of 2 or larger) kinds of light and deep color inks X1, X2, . . . , Xm (the inks become thin in color density in this order) for each hue, and n (n: natural number of 1 or larger) kinds of color inks Y1, . . . , Yn (the inks become thin in color density in this order) whose lightness values are larger than of the color inks X1, X2, . . . , Xm for the same recording rate, and the amounts vxk ($1 \leqq k \leqq m$) of the m kinds of color inks contained in the ink chambers thereof and the amounts vyi ($1 \leqq i \leqq n$) of the n kinds of color inks having large lightness values contained in the chambers thereof satisfy the following relations $$\sum_{i=1}^{n} vyi < \sum_{k=1}^{m} vxk \quad (n < m)$$

and vxi<vyi<vxi+vxi+1 (i: integer between 1 and (n−1)).

In the printing device, the total sum of the amounts of the inks having a high lightness for the same recording rate is smaller than that of the inks of another hue. When comparing the amounts of color inks of color densities with one another, the amount of chamber-contained ink having a color density of the n kinds of color inks having a high lightness is larger than the amounts of the chamber-contained inks having the higher color density of the m kinds of color inks, but is smaller than the total sum of the inks having the lower color density to the amount of ink. To be more specific, let us consider a case where consumed inks are the inks of the primary colors, cyan, magenta and yellow, and where for each of the cyan and magenta, three kinds of color inks, or light, medium and deep color inks are used, and for the yellow, two kinds of color inks, or light and deep yellow inks, are used. In this case, the total amount of two chamber-contained yellow inks is smaller than that the total amount of three cyan or magenta inks, and the amount of yellow of high color density is larger than of the magenta or cyan ink of the highest color density, but smaller than the sum of the amount of magenta or cyan ink of the highest color density and the amount of magenta or cyan ink whose color density is next to the former. Further, the amount of yellow ink of low color density is larger than of the cyan or magenta ink of a medium color density, but smaller than the sum of the amount of cyan or magenta ink of the medium color density and the amount of cyan or magenta ink whose color density is next to the former. By so selecting the amounts of both the inks contained in the ink chambers thereof, a great difference is not created between the amounts of the inks stored in the ink cartridge, and proper amounts of the inks are contained in the ink cartridge used by a printing device for printing a multi-tone image.

In the printing device, the printing device is an ink jet printing device, the head is a print head having at least six series of nozzle orifices for independently ejecting ink droplets of black, deep cyan, light cyan, deep magenta, light magenta, and yellow, and control means for causing the print head to eject, in accordance with image signals, ink droplets to form dots each forming one pixel by black ink, deep cyan ink, light cyan ink, deep magenta ink, light magenta ink, and yellow ink in this order.

The amounts of the m kinds of light and deep color inks contained in the ink chambers thereof, and the amounts of the n kinds of color inks contained in the ink chambers thereof are preferably determined in consideration with γ-characteristics of the color inks. A dye concentration (or a lightness of the print) of the ink of each color density is different every printing device. The amounts of the color inks for producing a print of a proper color density are different for each printing device. The γ-correction is used for compensating for those differences. By the γ-correction, the amounts of the color inks are properly set up.

BRIEF DESCRIPTION OF THE DRAWINGS

FIG. 16 is a table showing the gradients of color inks and the amounts of the color inks contained in the ink chambers;

FIG. 30 is a table showing the relationships between the printing orders of the color inks and graininess;

FIG. 31 is a table showing additional combinations of the amounts of the chamber-contained, light and deep color inks.

DESCRIPTION OF THE PREFERRED EMBODIMENTS

Figure 1:
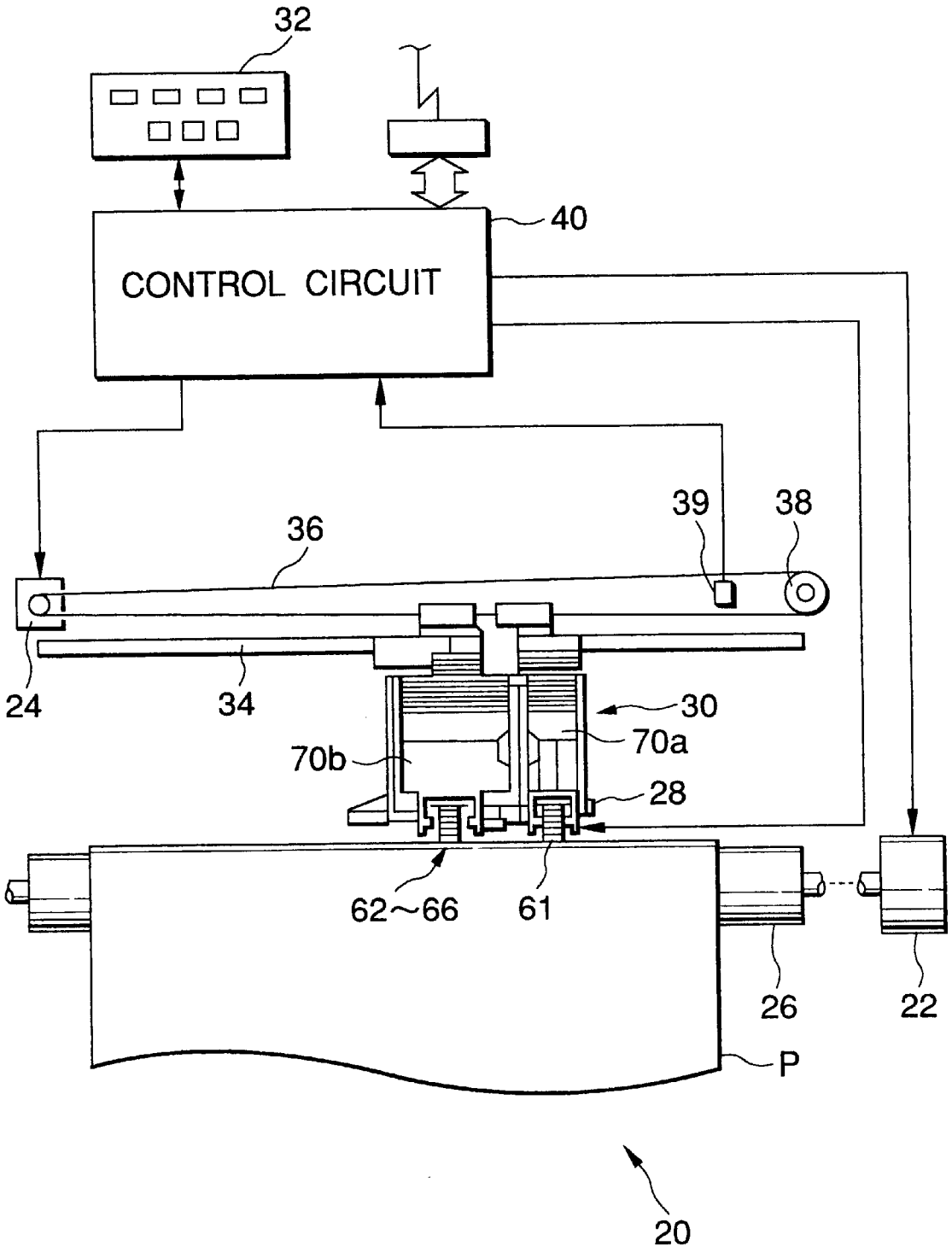
FIG. 1 is a diagram schematically showing a printer 20 according to an embodiment of the present invention.

The preferred embodiments of the present invention will be described. In the specification, the invention is embodied in the two forms; one is an ink cartridge and the other is a printer. An overall arrangement of a printer 20 will first be described for ease of explanation. As shown in FIG. 1, the printer 20 is constructed with a mechanism for feeding a thin print substrate, such as a sheet of paper P, under drive of a paper feed motor 22, a mechanism for reciprocatively moving a carriage 30 under drive of a carriage motor 24, a mechanism for controlling the ejection of ink droplets and the formation of dots by the ink droplets by driving a print head 28 mounted on the carriage 30, and a control circuit 40 for transferring control and its related signals to and from the paper feed motor 22, carriage motor 24, print head 28, and an operation panel 32.

The mechanism for feeding the paper P includes a gear train (not shown) for transmitting a rotation of the paper feed motor 22 to a paper feeding roller (not shown) as well as a platen 26. The mechanism for reciprocatively moving the carriage 30 includes a slide shaft 34, provided in parallel to the shaft of the platen 26, for slidably holding the carriage 30, a pulley 38 coupled with the carriage motor 24 by an endless drive belt 36 stretched therebetween, a position sensor 39 for sensing an original position of the carriage 30, and the like.

Figure 2:
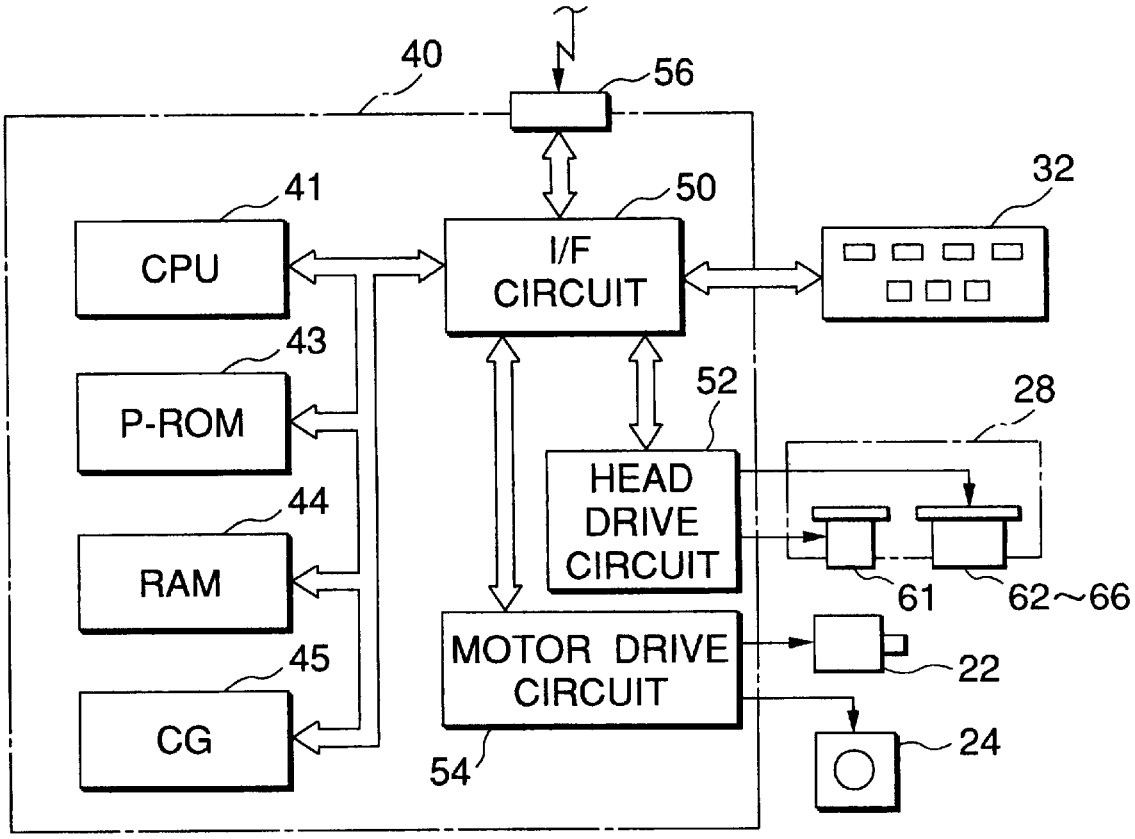
FIG. 2 is a block diagram showing a construction of a control circuit 40 contained in the printer 20.

An arrangement of the printer constructed laying stress on the control circuit 40 is shown in FIG. 2. As shown, the control circuit 40 is constructed as an arithmetic logic circuit including mainly a known CPU 41, a P-ROM 43 for storing programs and the like, a RAM 44, a character generator (CG) 45 for storing a character dot matrix. In addition, the control circuit 40 includes an I/F circuit exclusively used for an interface with external motors and the like, a head drive circuit 52 for driving the print head 28 connected to the I/F circuit 50, and a motor drive circuit 54 for driving the paper feed motor 22 and the carriage motor 24. The I/F circuit 50, containing a parallel interface 30 circuit, is connected to a computer via a connector 56, and may receive print signals from the computer. The image signals output from the computer will be described later.

Figure 3:
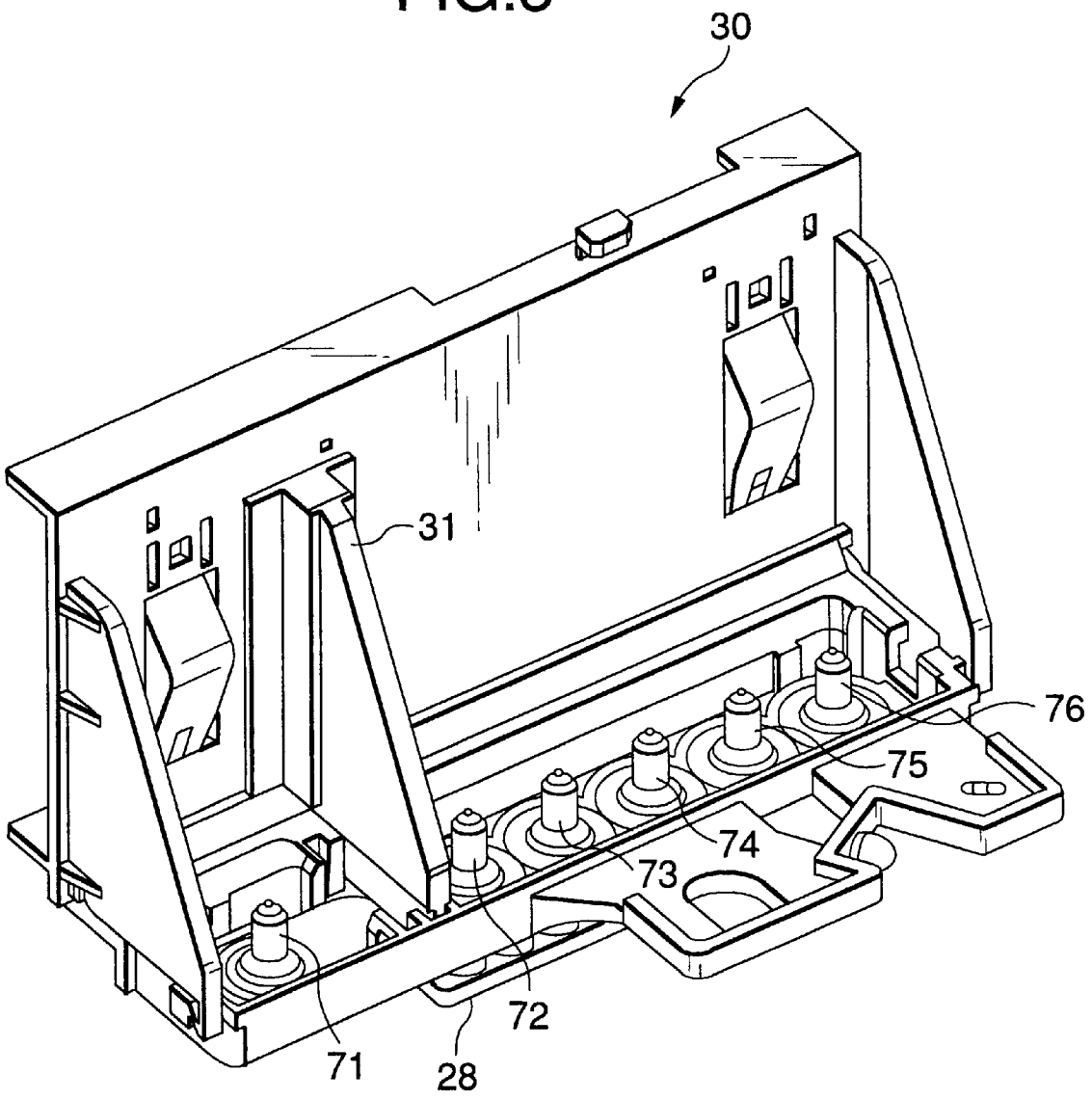
FIG. 3 is a perspective view showing a construction of a carriage 30.
Figure 4:
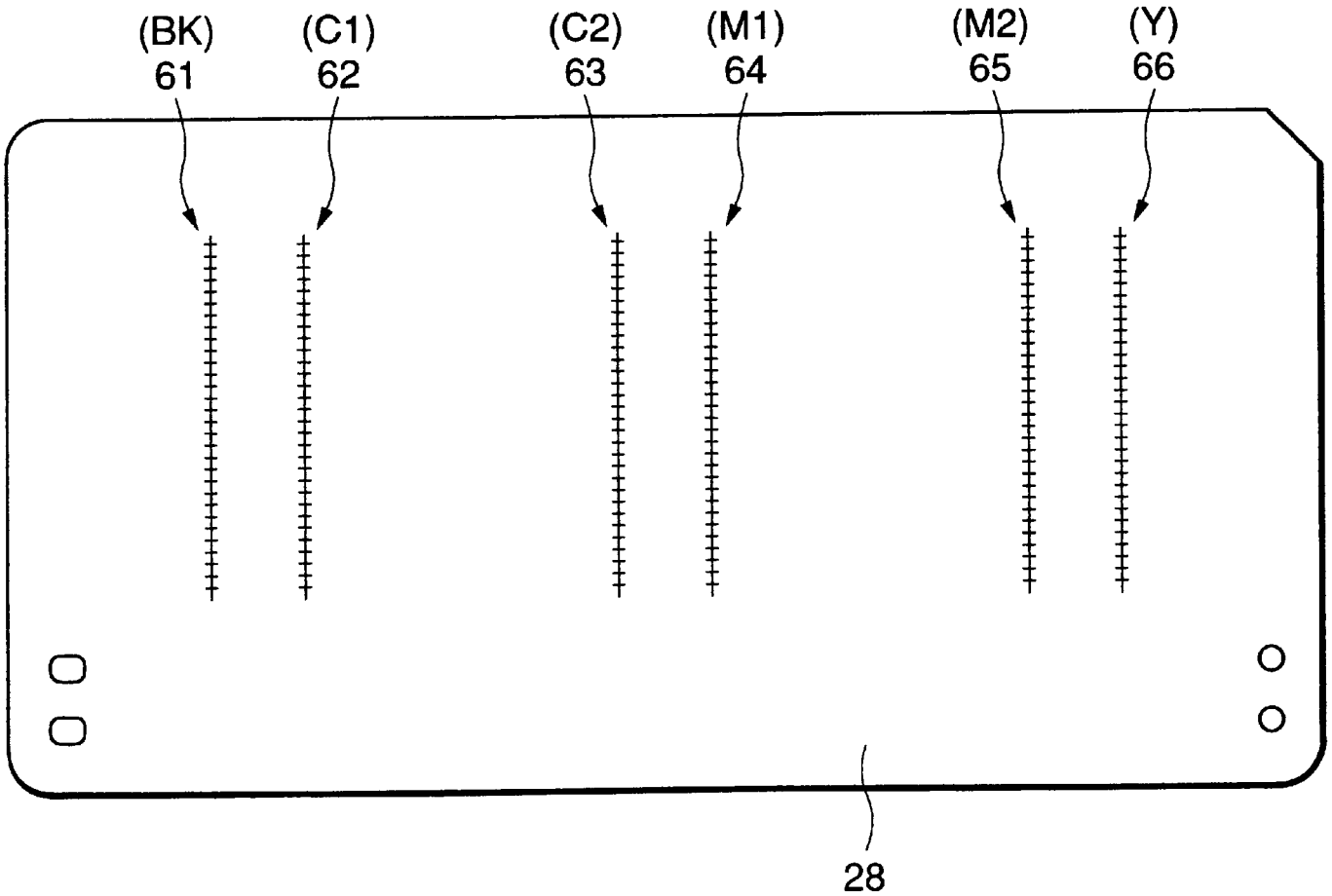
FIG. 4 is an explanatory diagram showing a layout of color ink heads 61 to 66 of a print head 28.

Description to follow is elaboration of a specific construction of the carriage 30, the structures of ink cartridges 70*a* and 70*b* mounted on the carriage 30, and the principle of ejecting ink droplets out of the print head 28 when it receives ink from the ink cartridges 70*a* nd 70*b*. FIG. 3 is a perspective view showing a construction of the carriage 30. FIG. 4 is a plan view showing color ink discharging nozzle arrays on the print head 28 disposed under the carriage 30. As shown in FIG. 3, the carriage 30, shaped like L, is designed so that a black ink cartridge 70*a*, not shown, and a color ink cartridge 70*b* (see FIG. 5) may be mounted thereon. The carriage 30 is provided with a partitioning wall 31. When mounted on the carriage, the cartridges are parted from each other by the partitioning wall 31 while being detachable from carriage. The print head 28, located under the carriage 30, is provided with a total of six ink introducing heads 61 to 66. Ink introducing pipes 71 to 76 for introducing ink from the ink tanks to the ink heads 61 to 66 stand upright on the bottom of the carriage 30. When the black ink cartridge 70*a* and the color ink cartridge 70*b* are set to the carriage 30 from above, the ink introducing heads 61 to 66 of the print head 28 are inserted into the ink supply ports of the cartridges, respectively.

Figure 6:
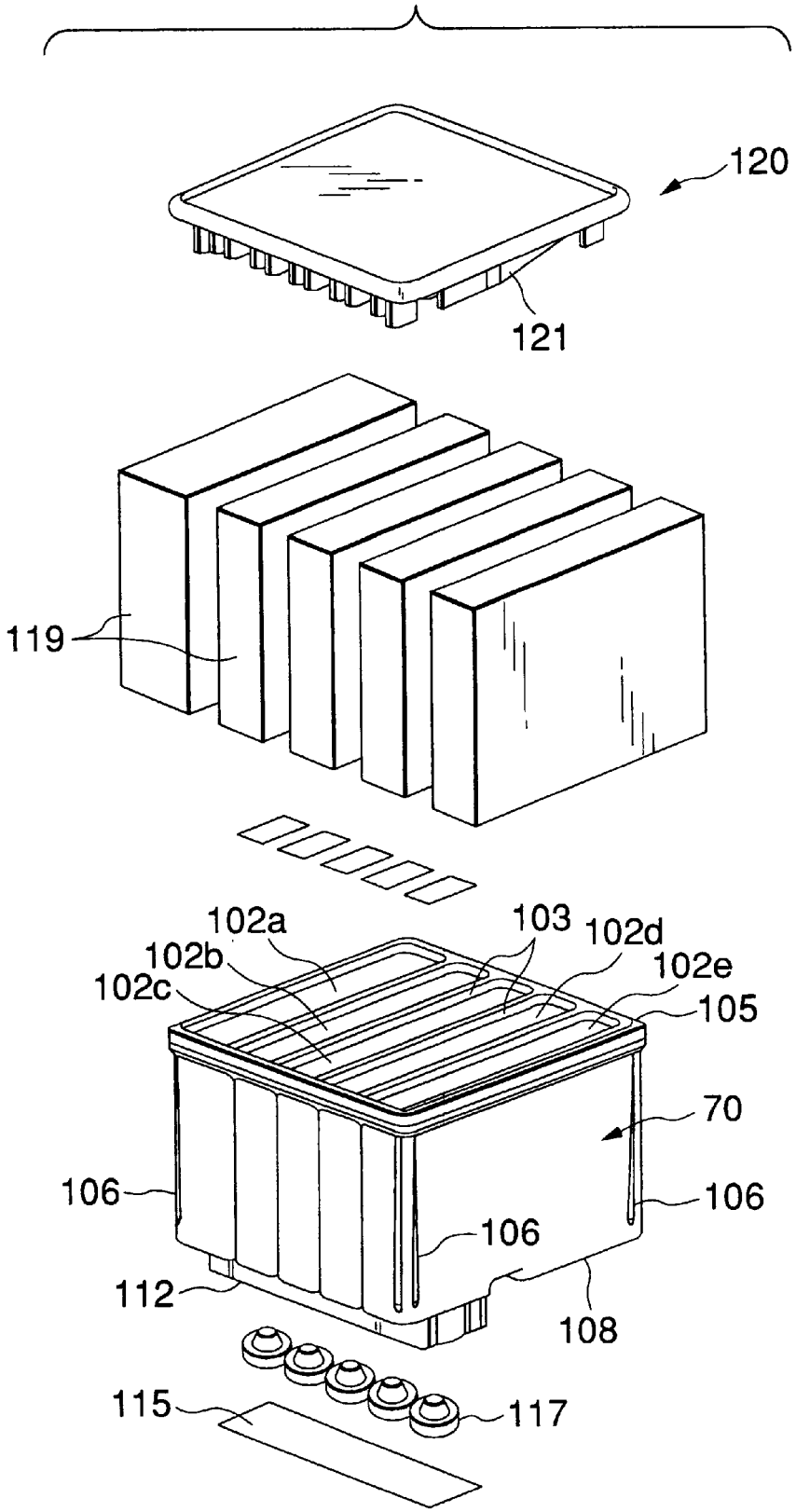
FIG. 6 is an exploded view perspectively showing the structure of a color ink cartridge 70*b;*

The inner structure of the color ink cartridge 70*b* will be described. FIG. 6 is an exploded view perspectively showing the structure of the color ink cartridge 70*b*. Two types of color inks of light and deep colors for magenta and cyan, and a total of five kinds of inks are contained in the color ink cartridge 70*b*. The color ink cartridge 70*b*, made of polypropylene, takes the form of a cuboid having a little extrusions from the surface thereof as a whole so as to have the largest possible volume. The color ink cartridge 70*b* includes ink chambers 102*b* to 102*e* for containing two types of color inks of light and deep colors of magenta and cyan, and an ink chamber 102*a*, wider than each of the above ones, for containing yellow ink. Those ink chambers are partitioned by partitioning walls 103. The yellow ink chamber 102*a* is located at the outmost end of a series of those chambers contained in the color ink cartridge 70*b,* and its volume is larger than of the remaining ones.

The outer wall 104 of the color ink cartridge 70*b* is thicker than the partitioning wall 103. The peripheral edge 105 of an opening of the top of the outer wall 104 is somewhat extended outward to be thicker than the remaining portion of the outer wall 104. Provision of the thick opening edge 105 provides a sufficient rigidity of the color ink cartridge 70*b*. Ribs 106 are integrally formed along the corners of the outer wall 104 of the ink cartridge. The ribs of the cartridge position the cartridge per se when the cartridge is mounted on the carriage 30, and hold the shape of their cartridge.

Figure 7:
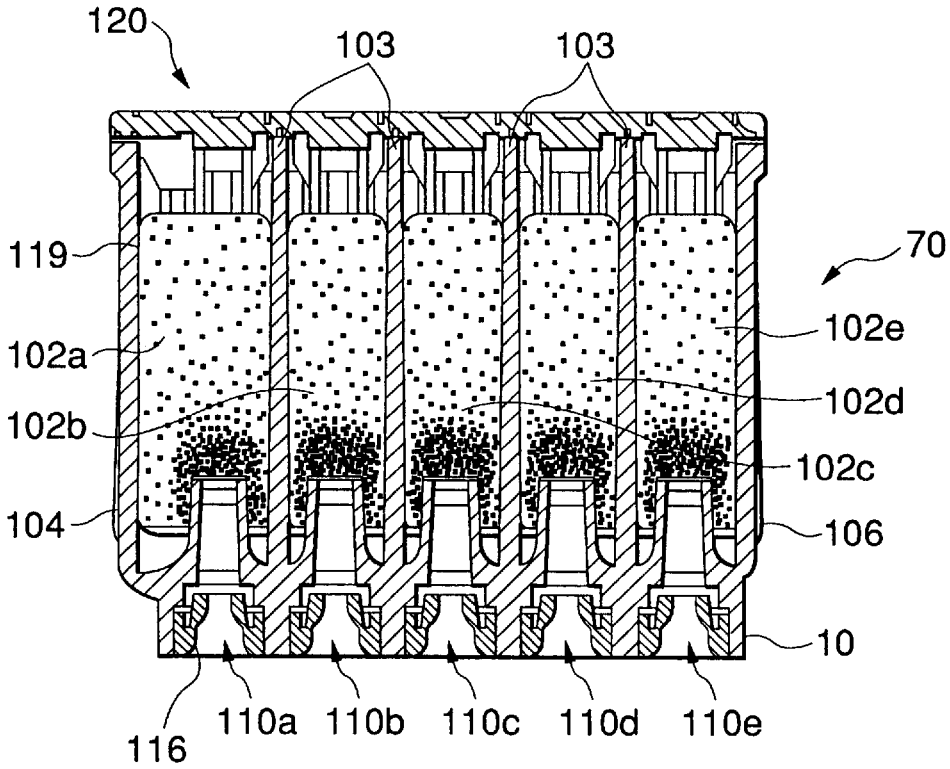
FIG. 7 is a cross sectional view showing an internal structure of the color ink cartridge 70*b;*
Figure 8:
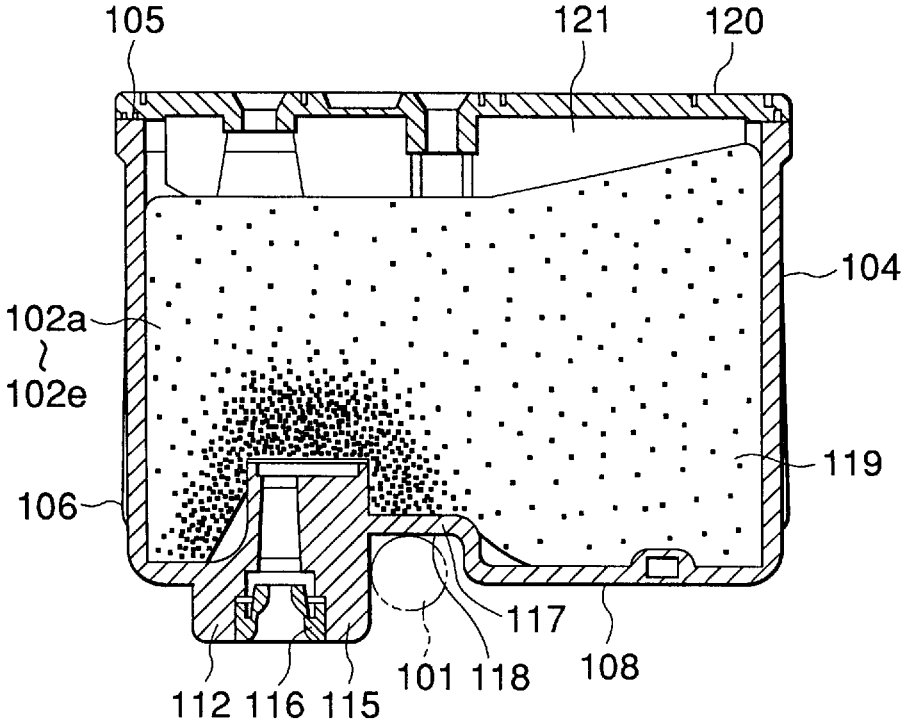
FIG. 8 is a cross sectional view showing the color ink cartridge 70*b* when it is cut at another position.
Figure 9:
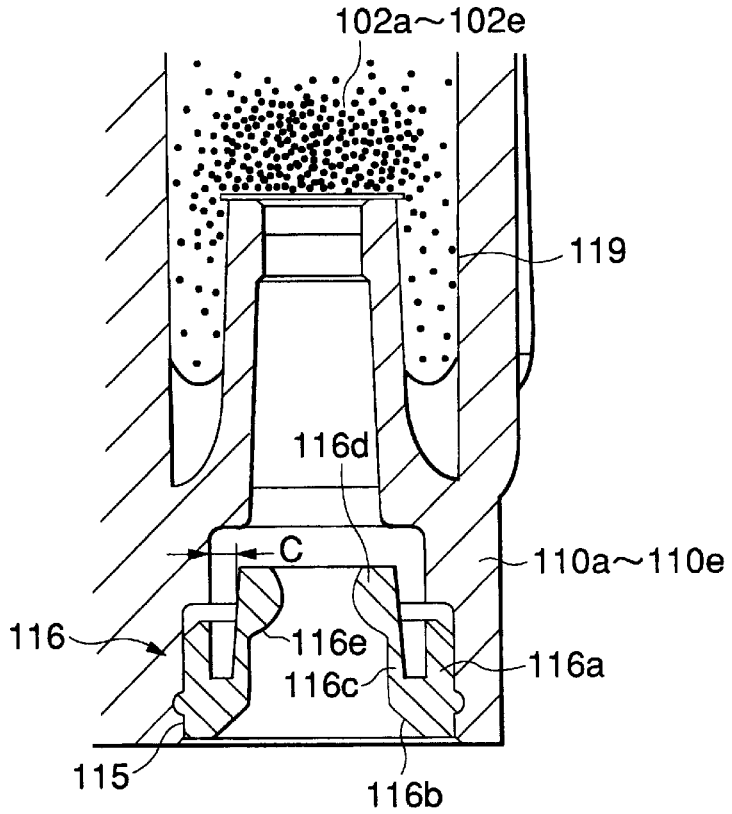
FIG. 9 is an enlarged view showing a portion in the vicinity of an ink supply port 110.
Figure 10:
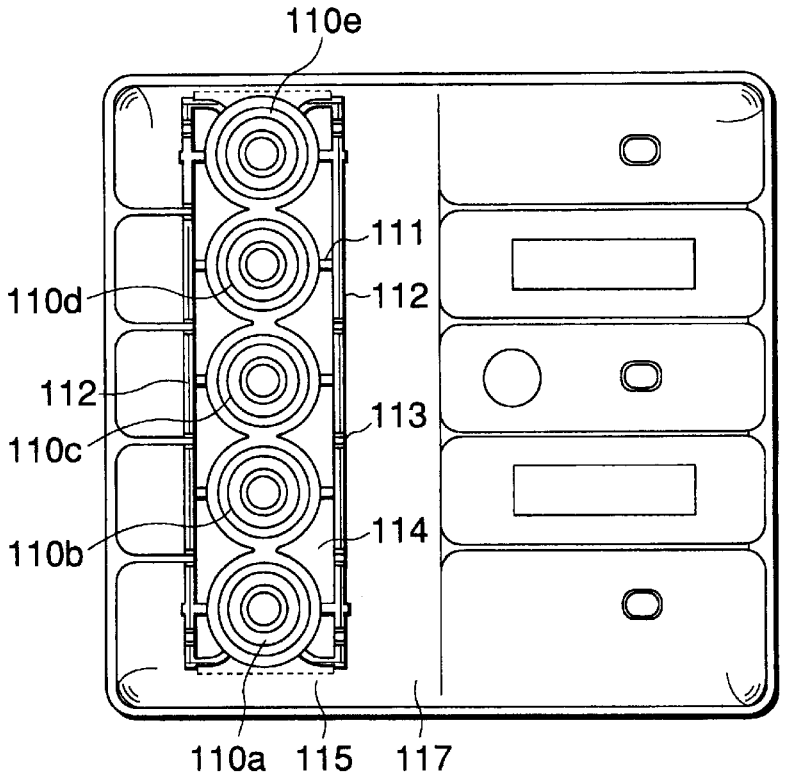
FIG. 10 is a bottom view of the color ink cartridge 70*b;*

Cylindrical ink supply ports 110*a* to 110*e*, coupled with one another, are provided while being protruded from the bottom surfaces of the ink chambers 102*a* to 102*e*. Configurations of the ink supply ports 110*a* to 110*e* are well illustrated in FIGS. 7 and 8 showing cross sections of the color ink cartridge 70*b*, FIG. 9 showing an enlarged view showing a part of the color ink cartridge, and FIG. 10 showing a bottom view of the same. The ink supply ports 110*a* to 110*e* are enclosed by a common frame 112, while being connected to the latter by means of ribs 111.

Both ends of the frame 112 are extended outside beyond the ink supply ports 110*a* and 110*e* of the series of those ports. The end faces of the frame 112 are sufficient in area, so that in storing the cartridge, all the ink supply ports 110*a* to 110*e* may be tightly sealed, at once, with a tape 115 with the tape being not extended from the outer wall 104. When the tape 115 is applied to there, air inside the space defined by the frame flows into air escape parts 114, and then flows out of the inner space through cutouts 113 formed on the upper edge of the frame 112. Therefore, the tape 115 can reliably be stuck onto the end faces of the frame 112.

These ink supply ports 110*a* to 110*e*, as shown in FIG. 7, are protruded from the bottom 108 of the ink cartridge while being arrayed at fixed intervals. The ink supply port 110*a* corresponding to the wide, yellow ink chamber 102*a* is deviated in location to the inner side when viewed from the ink chamber 102*a*. With this, ink introducing pipes 72 to 76 of the print head 28, which are protruded in the carriage 30, may be equidistantly arrayed corresponding to the ink supply ports 110*a* to 110*e*, respectively.

Sealing means 116, made of rubber (silicone rubber), are fit into the ink supply ports 110*a* to 110*e*, respectively. With these sealing means, the ink introducing pipes 72 to 76 are hermetically inserted into the ink supply ports 110*a* to 110*e*, respectively. Each of the sealing means 116, which are fit to the ink supply ports 110*a* to 110*e*, as shown in FIG. 9, includes a cylindrical fitting part 116*a*, a slanted guide part 116*b*, a flexible part 116*c*, a ring-like fitting part 116*d*, and a slanted guide part 116*e*. When the sealing means 116 are fit to the ink supply ports, the outer surface of the fitting part 116*a* of each sealing means 116 frictionally comes in contact with the inner surface of the corresponding ink supply port 110. The guide part 116*b* is obliquely extended from the inner surface of the opening end of the fitting part 116*a*, and the flexible part 116*c* is extended inward from the guide part 116*b*. The flexible part 116*c* is a thin cylindrical extension substantially parallel to the cylindrical fitting part 116*a*, with a gap c being present between those parts. The guide part 116*e* is extended upward (when viewed in the drawing) from the inner end of the flexible part 116*c*, and the fitting part 116*d* is extended upward from the guide part 116*e* while protruded inward. The fitting part 116*d* tightly comes in contact with the incoming ink supply needle of the print head. When the color ink cartridge 70*b* is set to the print head mounted on the carriage, the ink introducing pipes 72 to 76 are guided by the guide parts 116*b* of the sealing means 116 and then the guide part 116*e* thereof into the ink supply ports 110. At the completion of the setting of the color ink cartridge 70*b* the ink introducing pipes 72 to 76 are smoothly put in close contact with the fitting parts 116*d* of the sealing means. Therefore, the sealing means 116 exercise their highly sealing functions even where the ink supply ports 110*a* to 110*e* are closely arrayed in series.

A filter 201 is attached on an ink supply port above a filter chamber 202. In flow passages 203, 204 and 205 defined in the ink supply port communicate with filter chamber 202. Ink flow passage 204 is tapered. An ink space 206, which is reversed U-shaped in cross section, is defined between ink flow passages 203, 204 and 205 and seal member 116. Ink space 206 communicates with ink flow passages 203, 204 and 205 as shown in FIG. 9 for allowing ring-like fitting part 116*d* of sealing member 116 to deform radially outwardly when ink introducing pipes (ink supply needles) 72 to 76 are inserted therethrough. An idle gap 207 is defined by a tip end of the cylindrical fitting part 116*a* and a shoulder part 208 of the ink supply port so that it allows a protruding ring 209 to completely fit in a groove formed in the ink supply port.

An engaging groove 117 is formed along the array of the ink supply ports 110*a* to 110*e* on the bottom 108 of the color ink cartridge 70*b*. By fitting a support bar 101 of a lifter provided on the carriage 30 into the engaging groove 117, the black ink cartridge 70*a* and the color ink cartridge 70*b* are correctly set to the print head. The engaging groove 117 includes a stepped part 118. Provision of the stepped part 118 brings about the following useful effects. It is impossible to completely discharge ink staying in a place in the color ink cartridge 70*b* where is lower than an ink exit port by the capillary action of a foam 119. The stepped part 118 excludes the presence of the foam 119 in this place within the color ink cartridge 70*b*, to reduce an amount of ink left in the cartridge. For packaging the color ink cartridge 70*b*, the cartridge is put in an aluminum pack, and reduced in pressure therein. In this case, a space for pressure reduction is required. The stepped part 118 provides such a space.

Figure 11A:
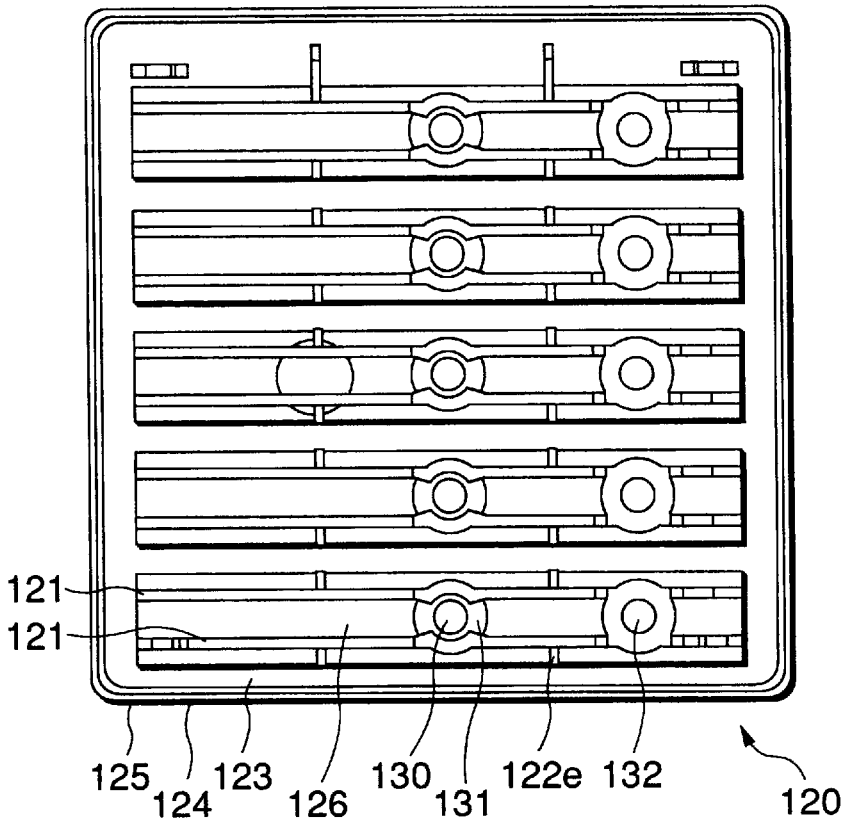
FIGS. 11*a*–11*c* is a view showing a lid 120 when viewed in three directions.
Figure 11B:
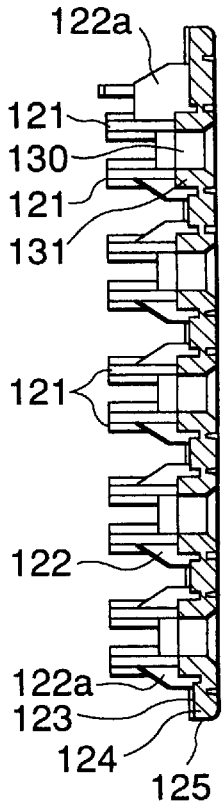
Figure 11C:
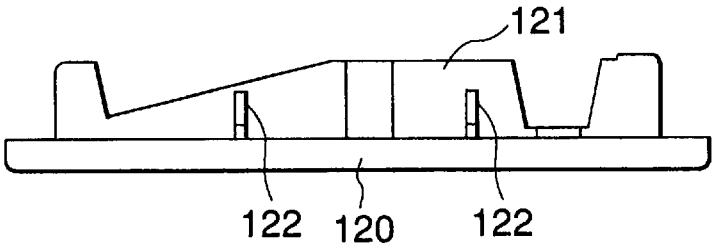

The upper structure of the color ink cartridge 70*b* will be described. A lid 120 for sealingly cover the opening of the color ink cartridge 70*b* may be fit to the top of the color ink cartridge 70*b*. A configuration of the lid 120 is best illustrated in FIG. 11. As shown, pairs of longitudinal ribs 121 for pressing the foam 119 contained in the ink chambers 102*a* to 102*e*, while being protruded from the lid 120, are provided at fixed spatial intervals in association with the ink chambers 102*a* to 102*e*, respectively. Those ribs have each such a length as to allow the lid 120 to slightly slide in the longitudinal direction. A portion of each rib, closer to the ink supply ports 110, is higher than the remaining portion thereof. A state of the ribs 120 when these are mounted on the color ink cartridge 70*b* is well illustrated in FIG. 8. When the lid 120 is applied to the body of the color ink cartridge 70*b*, the ribs 121 more strongly press the foam 119 in this portion than in the remaining portion since the portion of the ribs closer to the ink supply ports 110 is higher, whereby the voids of the portion of the foam 119 closer to the ink supply ports, are compressed. As a result, the capillary action is more intensive in this foam portion than in the remaining foam portion. Ink uniformly absorbed in the foam 119 is gathered in the area in the vicinity of the ink supply ports 110 with decrease of the amount of sucked ink.

Outside the ribs 121, the reinforcing horizontal ribs 122 are raised from the lid while being extended in the direction orthogonal to the longitudinal direction. The horizontal ribs 122 are in contact with the partitioning walls 103 that partition the ink chambers 102*a* to 102*e*, as well as the inner surface of the outer wall 104, whereby preventing those from being bent inward. As shown in FIG. 11(*b*), reinforcing horizontal ribs 122*a* and 122*e* are provided for the outermost ribs 121, respectively. The outer sides of the horizontal ribs 122*a* and 122*e* define surfaces 123 welded to welding margins 105*a* (FIG. 11(*a*)) protruded from the top face of the outer wall 104. Each welding surface 123 reaches outer protruded edges 125 of the lid, with a thin groove 124 for receiving welding dust droplets produced at the time of welding process being located between them.

Figure 12:
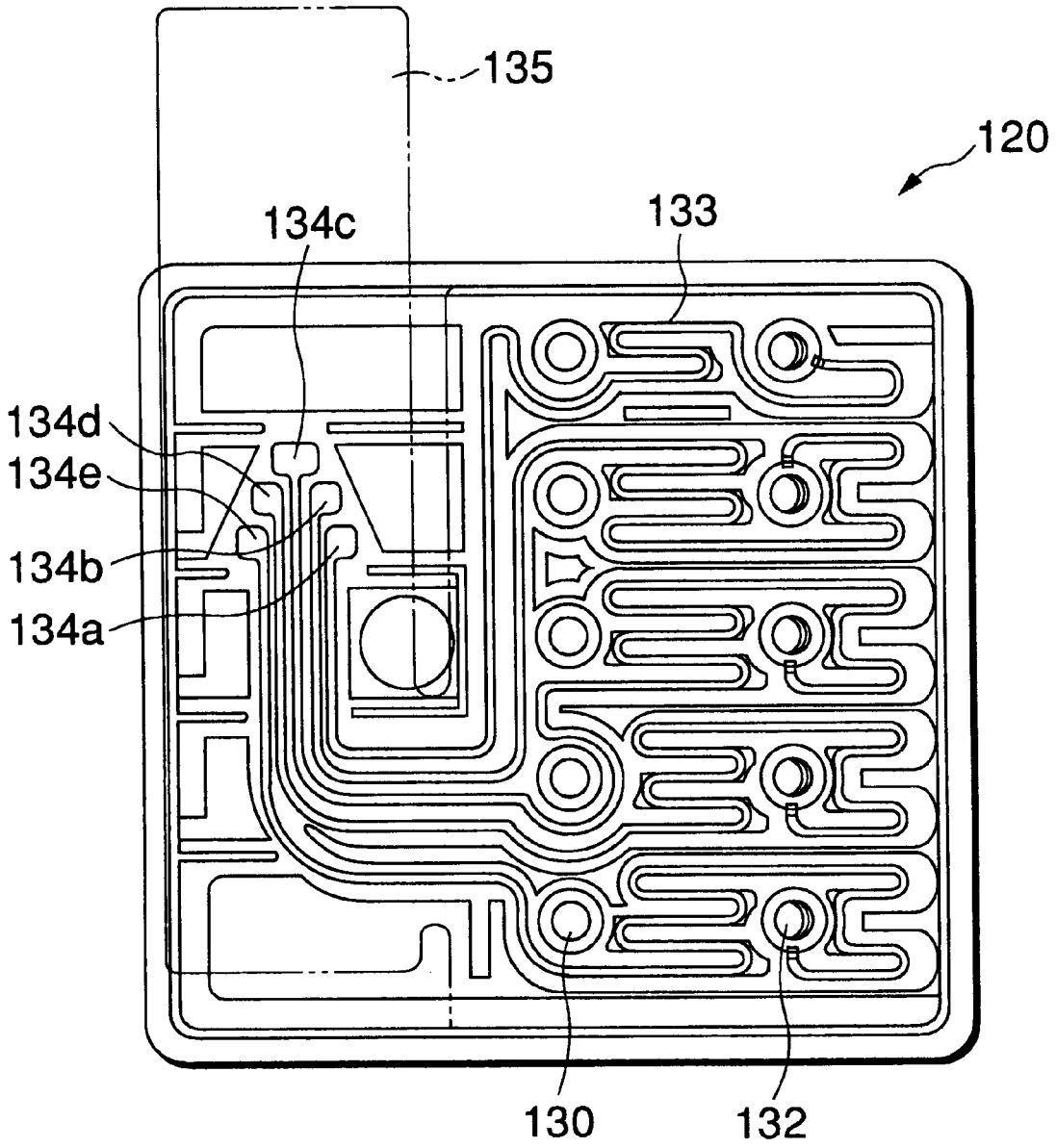
FIG. 12 is a view showing the end face of the color ink cartridge 70*b*, in which snake grooves 133 are well illustrated.

As shown in FIG. 12, a series of ink filling holes 130 and a series of air discharging holes 132 are provided in the portions of the top of the lid 120, a central portion and a portion located closer to the ink supply ports 110, while corresponding to the ink chambers 102*a* to 102*e*. The ink filling holes 130, as shown in FIGS. 11(*a*) and 11(*b*), take the form of cylindrical walls 131 the height of which is below the height of the ribs 121 within the inner wall of the lid 120, and partially interrupt passages 126 each present between the paired ribs 121.

As shown in FIG. 12, snake grooves 133 of which the start ends are communicatively connected to the air discharging holes 132 are formed on the upper surface of the lid 120 in a labyrinth fashion. The snake grooves 133 are provided for each of the ink chambers 102*a* to 102*e*. The terminal ends of the snake grooves 133 reach air passage parts 134*a* to 134*e*, gathered at a given location (farthest from the air discharging holes 132) on the upper surface of the lid 120. Before the color ink cartridge 70*b* is mounted on the carriage 30 of the printer 20, of a film 135 covering the upper surface of the color ink cartridge 70*b*, its portion covering the air passage parts 134*a* to 134*e* is peeled off. As a result, the ink chambers 102*a* to 102*e* are exposed to the air through the snake grooves 133. It is noted, however, that the long snake grooves 133 impede the evaporation of ink within the cartridge.

The air passage parts 134*a* to 134*e* of the terminal ends of the snake grooves 133, which are gathered at one specific location, are arrayed in a triangle oriented such that its vertex lies at the front when viewed in the direction of stripping the film. In this case, one (the air passage part 134*e* in this embodiment) of the air passage parts 134*a* to 134*e* lies at the vertex of the triangle array. Therefore, it is easy to strip the film 135 from the upper surface of the lid.

The snake grooves 133 are different in their width and depth when viewed in their cross section. By so configured, when the film 135 is welded by a heater chip, there is no chance that the grooves are filled with the film in the overlapping portion of the film or are flattened when those grooves are pressed against the partitioning walls 103 and the outer wall 104.

A process of manufacturing the ink cartridge 70 thus constructed will be described. To begin with, a lid 120 is assembled into the ink cartridge 70. In the assembling work, the lid 120 is put on the ink cartridge 70 in a state that it covers the opening of the cartridge. Then, it is slid in the lengthwise direction. The welding margins 105*a* protruded outward at the end faces of the outer wall 104 and the welding surfaces 123 of the lid 120 are welded together by their sliding resistance. At this time, the partitioning walls 103 and the outer wall 104 are not deformed since those are protected by the reinforcing horizontal ribs 122 raised outside the ribs 121. The welding dust generated during the welding process are gathered into the thin groove 124 in the inner surface of the lid 120. In this way, the ink cartridge 70 and the lid 120 are coupled into a unit with a gap of approximately 0.2 mm present therebetween.

Ink of small surface tension is injected into the ink cartridge 70 through the ink filling holes 130 of the lid 120. The cartridge is slanted at approximately 30° in a state that the air discharging holes 132 are located in the upper side. In this state, the film 135 is stuck on the upper surface of the lid 120 while decreasing the pressure in the ink cartridge. The compositions of the ink to be injected into the cartridge will be described later.

The pressure reduction entails generation of bubbles in the foam 119 of the ink chambers 102*a* to 102*e*. The bubbles move bypassing the cylindrical walls 131 of the ink filling holes 130, which are projected partially interrupting the passages 126 each between the paired ribs 121. With evaporation of the bubbles, the bubbles are separated into air and ink. Only air flows to the upper surface of the lid 120 through the air discharging holes 132, and pass through the snake grooves 133 and flow into the air passage parts 134*a* to 134*e* being in contact with the film 135. Therefore, when the cartridge is used, a part of the film 135 is stripped off from the upper surface of the lid 120 to expose the air passage parts 134*a* to 134*e*, whereby the ink chambers 102*a* to 102*e* is opened to the air. When the ink chambers 102 are opened, ink is allowed to flow outside from the ink supply ports 110, and the ink cartridge is ready for its use.

In the embodiment, the color ink cartridge 70*b* is made of polypropylene, but any other material may be used if it is soft synthetic resin of moisture impermeability, for example, high density polyethylene. In the description, the structure of the black ink cartridge 70*a* is not referred to in particular. However, the basic structures of the black ink cartridge 70*a*, for example, the ink filling structure using the foam 119 and the structure of the sealing means 116 of the ink supply ports, are exactly the same as of the color ink cartridge 70*b*.

In the above-mentioned embodiment, it is noted that the spatial intervals between the ink supply ports provided on the bottom of the color ink cartridge 70*b* are equal. The intervals of the array of the ink introducing pipes 72 to 76 provided on the carriage 30 and the holding intervals of the sealing means 116 fit into the ink supply ports 110 can be uniquely determined in harmony with the intervals of the array of the ink supply ports 110. Therefore, the assembling work is easy and the assembling accuracy is improved.

The sealing means 116 to be fit into the ink supply ports 110 can be reduced in diameter. The sealing means 116 to be fit into the ink supply ports 110 may be sufficiently deformed in diameter. Further, the sealing means 116 absorbs a positional incoincidence that is inevitably created between the ink cartridge 70 and the ink introducing pipes 72 to 76 when the ink cartridge 70 is mounted to the carriage, whereby the ink introducing pipes are prevented from being broken and may be smoothly be inserted into ink supply ports.

The pairs of the ribs 121, which is higher in the region of the ink supply ports 110, are provided on the inner surface of the lid 120. With the ribs, the foams 119 are compressed, the bubbles are reduced in diameter, and the capillary force is increased. Therefore, it is possible to use the largest possible amount of ink within the ink chambers 102 of the limited volumes. By making use of the ribs 121 provided for each of the ink chambers 102, the reinforcing horizontal ribs 122 for minimizing the deformation of the partitioning walls and the outer wall are provided on the outer sides of those ribs, whereby preventing in advance the deformation of the ink cartridge, which will be caused at the time of sliding resistance welding.

The printer 20 which is a printing device according to another embodiment of the present invention will be described. When the black ink cartridge 70*a* and the color ink cartridge 70*b* are set to the carriage 30, the ink introducing pipes 72 to 76 are inserted into the ink supply ports 110*a* to 110*e* of the color ink cartridge 70*b*, and the ink introducing pipe 71 is inserted into the black ink cartridge 70*a* (FIG. 3). By making use of the capillary action, ink is sucked out of the foam 119 of the ink cartridge 70 which stores the ink, and introduced into the ink introducing heads 61 to 66 of the print head 28 by way of the ink introducing pipes 71 to 76. When the ink cartridges are first set to the carriage, ink is sucked into the color ink heads 61 to 66 by a pump, exclusively used for the ink sucking. Description on the constructions of the ink sucking pump, the cap used capping the print head 28 at the time of ink sucking, and the like are omitted because those are not essential to the present invention.

Figure 13:
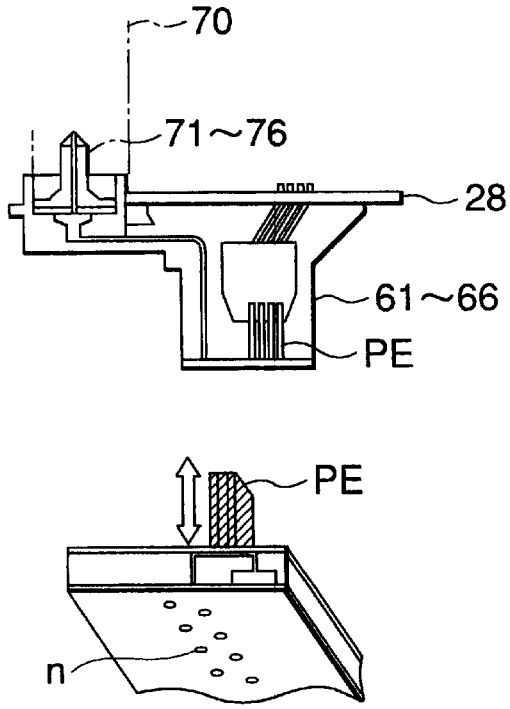
FIG. 13 is an explanatory diagram showing a construction for causing the color ink heads 61 to 66 to eject ink droplets.
Figure 14:
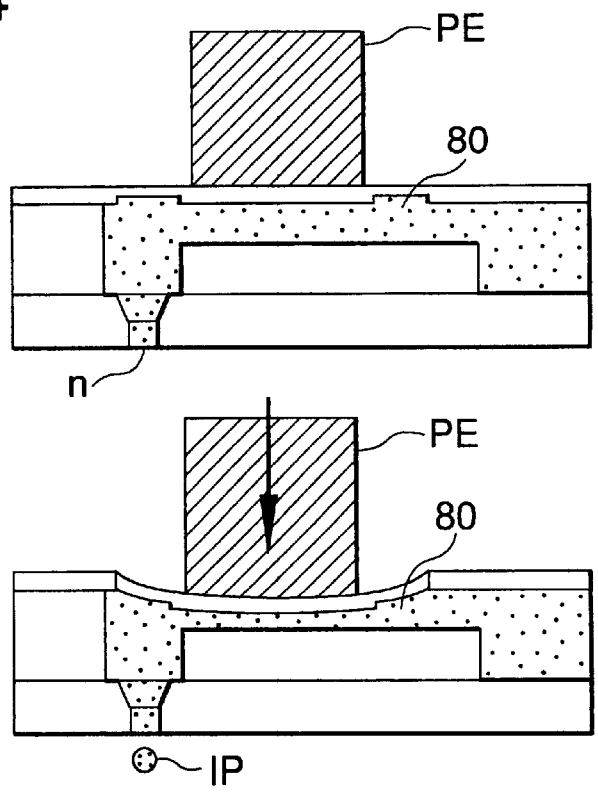
FIG. 14 is an explanatory diagram suitable for explaining how an ink droplet Ip is ejected by an expansion of the piezoelectric element PE.

A total of 32 nozzles n are provided for each color ink heads 61 to 66, as shown in FIGS. 4 and 13. A piezoelectric element PE is provided for each nozzle. The piezoelectric element PE is one of electrostrictive strain elements and excellent in response. A structure including the piezoelectric element PE and the nozzle n is illustrated in detail in FIG. 14. As shown, the piezoelectric element PE is located in close proximity to an ink passage 80 for introducing ink to the nozzle n. As well known, when the piezoelectric element PE is placed under a voltage applied thereto, its crystal structure is strained and the element converts electrical energy to mechanical energy at extremely high speed. In the embodiment under discussion, a voltage is applied to between electrodes of the piezoelectric element PE for a predetermined time period. Then, the piezoelectric element PE expands for the time period of voltage application to deform one side wall of the ink passage 80 (the lower part of FIG. 14). The ink passage 80 reduces its volume in accordance with the expansion of the piezoelectric element PE. An amount of ink corresponding to the reduced volume of the passage is ejected in the form of an ink droplet Ip from the tip of the nozzle n. The ink droplet Ip permeates a sheet of paper P set on the platen 26, to effect the printing.

The color ink heads 61 to 66 of the print head 28 are arrayed as shown in FIG. 4 in consideration of the provision of the piezoelectric elements PE. As shown, color ink heads are paired and three pairs of color ink heads are arranged side by side. The black ink head 61 is located at one end of the color ink head array while being close to the black ink cartridge. The cyan ink head 62 is located next to the black ink head 61. These color ink heads are paired in the ink head array. Another cyan ink head 63 and the magenta ink head 64 are paired, and located next to the pair of the ink heads 61 and 62. The cyan ink (called a light cyan ink) of the ink head 63 is lighter than that of the cyan ink head 62. Another magenta ink head 65 and the yellow ink head 66 are paired and located next to the pair of the ink heads 63 and 64. The magenta ink (light magenta) of the ink head 65 is lighter than a normal magenta ink. The composition and densities of those color inks will be described later.

Figure 5:
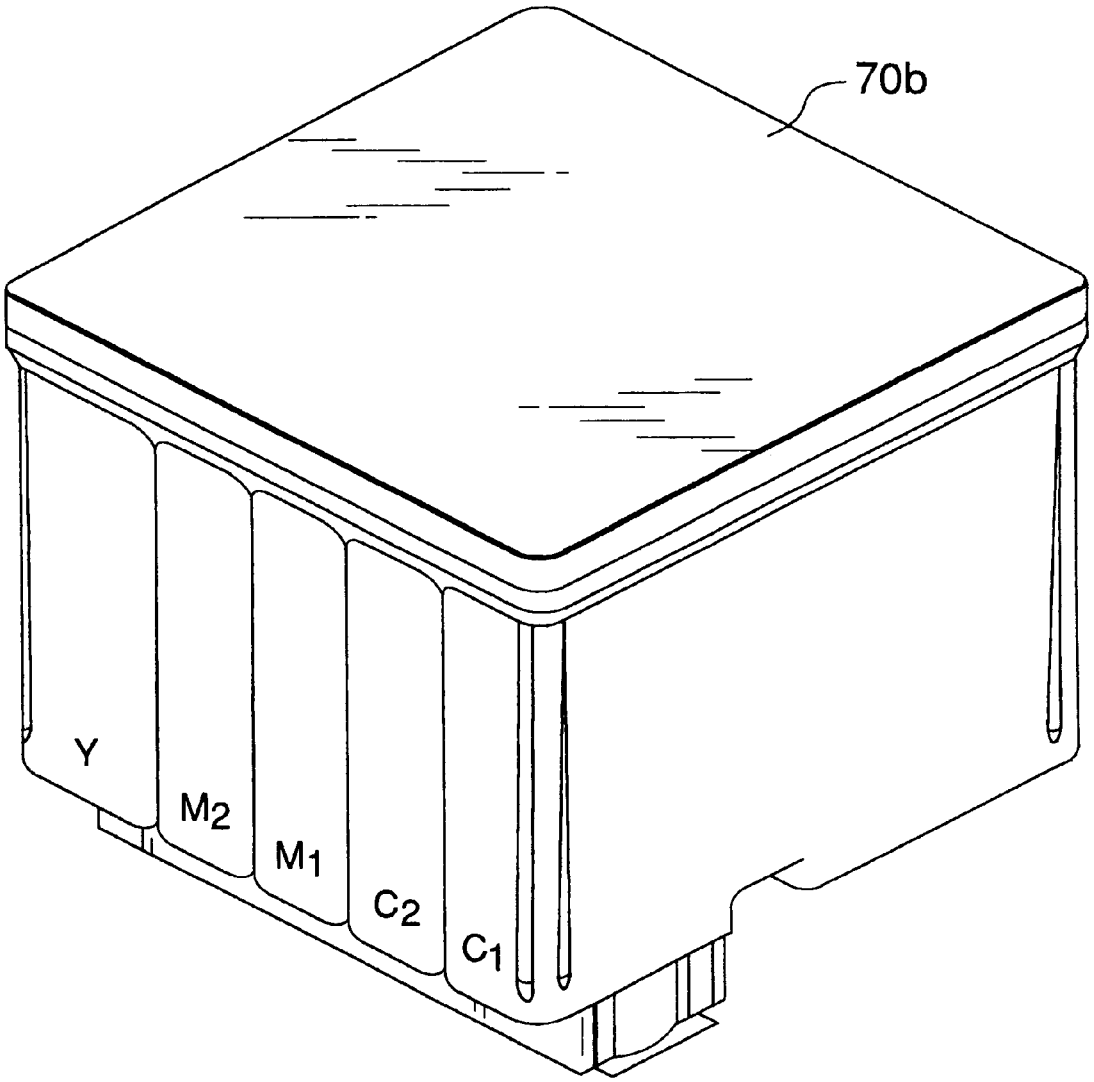
FIG. 5 is a perspective view showing an external appearance of the ink cartridge 70 for containing color inks.

As shown in FIGS. 3, 4, 5 and 13, the ink chambers 102*e* to 102*a* of the color ink cartridge 70*b*, the ink introducing pipes 72 to 76, and the color ink heads 62 to 66 are arrayed exactly in one-to-one correspondence, respectively. To be more specific, in the color ink cartridge 70*b*, as shown in FIG. 5 the yellow ink chamber 102*e* whose volume is the largest of those ink chambers contains yellow ink, and connected to the yellow ink head 66 through the ink introducing pipe 76. The ink chamber 102*b* containing light magenta M2, located adjacent to the yell ink chamber 102*a*, is connected to the light magenta ink head 65 through the ink introducing pipe 75. The ink chamber 102*c* containing magenta M1 is connected to the magenta ink head 64 through the ink introducing pipe 74; the ink chamber 102*d* containing light cyan ink C2 is connected to the light cyan ink head 63 through the ink introducing pipe 73; and the ink chamber 102*e* containing cyan C1 is connected to the cyan ink head 62 through the ink introducing pipe 72. A tube, not shown, is connected from the ink introducing pipe 71, which is coupled with the black ink cartridge 70*a*, to the print head 28, and to the black ink head 61. Those elements are arranged in one-to-one correspondence, and the connections range from of the ink chambers of the ink cartridges ranges to the color ink heads 61 to 66, respectively.

Figure 15:
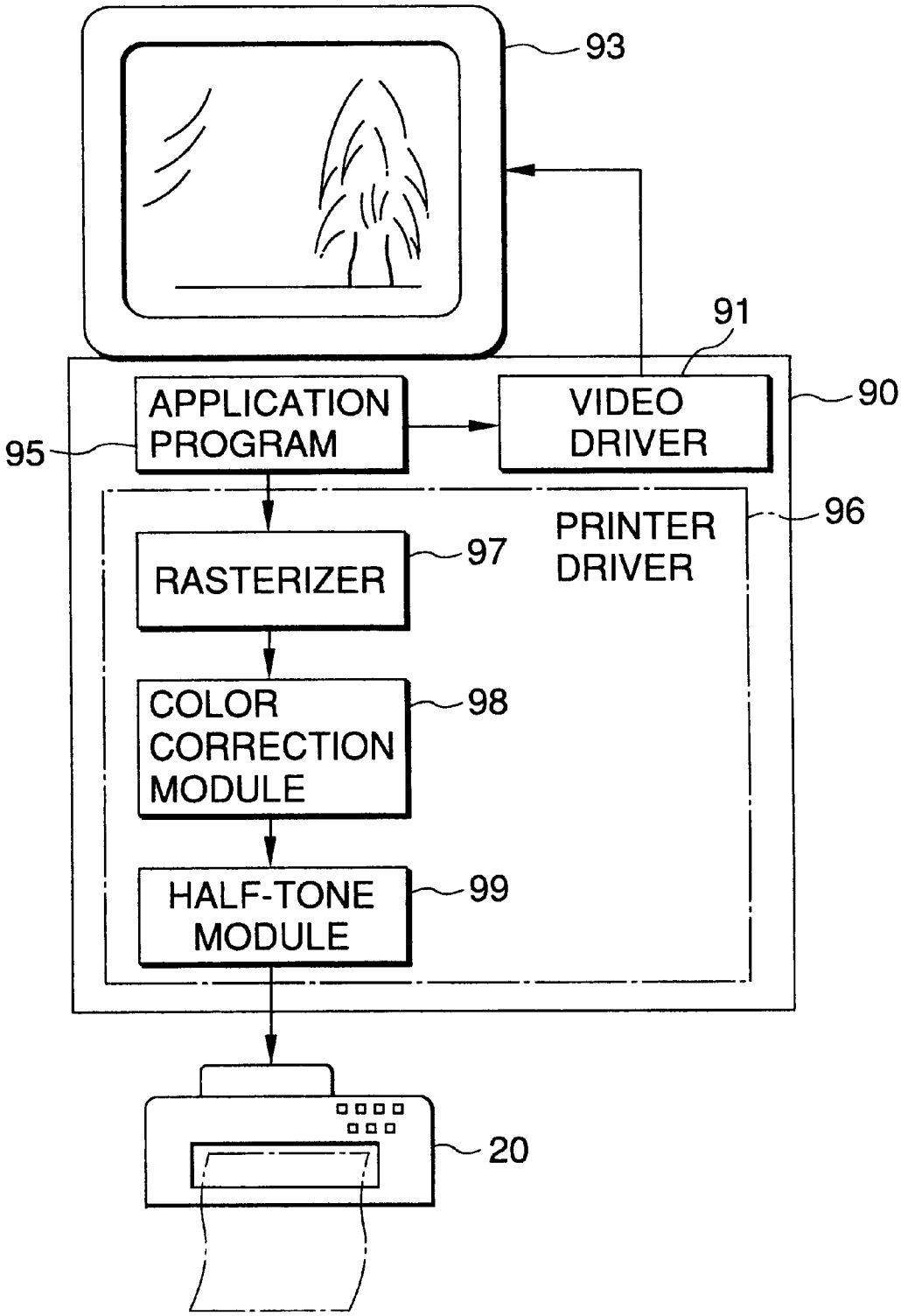
FIG. 15 is a block diagram showing a process ranging from image information handled by a computer 90 to the printing based on the image information.

To form a multi-color image on the paper P, the printer 20 having the thus constructed hardware operates in the following way. The platen 26, the rollers and the like are turned by the paper feed motor 22, to thereby feed the paper P. The carriage 30 is reciprocatively moved by the carriage motor 24. The piezoelectric elements PE of the color ink heads 61 to 66 of the print head 28 are driven to eject drops of the color inks. In this case, the printer 20 receives signals from an image forming apparatus including a computer 90 by way of the connector 56, to form a multi-color image (FIG. 15). In this instance, an application program running within the computer 90 displays an image on the screen of a CRT display 93 by way of a video driver 91, while carrying out an image processing. When the application program 95 issues a print instruction, a printer driver 96 receives image information from the application program and converts it into a signal by which the printer 20 can perform the printing. In the instance of FIG. 15, the printer driver 96 includes therein a rasterizer 97, a color correction module 98, and a half-tone module 99. The rasterizer 97 converts the image information handled by the application program 95 into dot-basis color information. The color correction module 98 applies a color correction to the image information (tone data) as the dot-basis color information in accordance with a color development characteristic of the image outputting device (printer 20 in this embodiment). The half-tone module 99 generates so called half-tone image information to express an optical density in an area in the form of presence and absence of ink for each dot on the basis of the image information after color corrected. The operations of those modules are well known and hence description of them is omitted, and the details of the half-tone module 99 will be described later.

As described above, in the printer 20 of the present embodiment, the print head 28 includes the print heads 63 and 65 of light cyan and light magenta inks, in addition to the ink heads of four colors of C, M, Y and K. The light cyan and magenta inks are formed by reducing dye concentrations of normal cyan and magenta inks, as seen from the ingredients of the inks shown in FIG. 16. As shown, the cyan ink of a normal concentration (denoted as C1 in FIG. 16) contains 3.6 wt % of direct blue 199 as dye, 30 wt % of diethylene glycol, 1 wt % of Surfynol 465, and 65.4 wt % of water. The light cyan ink (denoted as C2 in FIG. 16) contains 0.9 wt % (¼ in the cyan ink C1) of direct blue 199 as dye, 35 wt % of diethylene glycol as viscosity adjustment, and 63.1 wt % of water. The magenta ink of a normal concentration (denoted as M1 in FIG. 16) contains 2.8 wt % of acid red 289 as dye, 20 wt % of diethylene glycol, 1 wt % of Surfynol 465, and 76.2 wt % of water. The light magenta ink (denoted as M2 in FIG. 16) contains 0.7 wt % (¼ in the magenta M1) of acid red as dye, 25 wt % of diethylene glycol, and 73.3 wt % of water.

As shown in FIG. 16, the yellow ink Y and the black ink K are direct yellow 86 and food black 2 for dye, which are 1.8 wt % and 4.8 wt %. Viscosities of those inks are adjusted to approximately 3 [mPa.s]. In the present embodiment, the surface tensions of those inks as well as the viscosities are adjusted to be substantially equal. Therefore, the piezoelectric elements PE of the color heads can be equally controlled irrespective of the kinds of the inks to form dots.

The amounts of the color inks contained in the color ink cartridge 70*b* are as shown in FIG. 16. The amount vy of yellow ink is 28 g in root-mean-square value, and the amounts vm1, vm2, vc1 and cv2 of the magenta ink, light magenta ink, cyan ink and light cyan ink are each 20 g. Those amounts of inks are related as follows:

$$vy<vc1+vc2, \text{ and } vy<vm1+vm2.$$

Further, $$vc1<vy \text{ and } vm1<vy.$$

Additionally, $$vy\leqq 1.5\cdot vc1 \text{ and } vy\leqq 1.5\cdot vm1.$$

Figure 17:
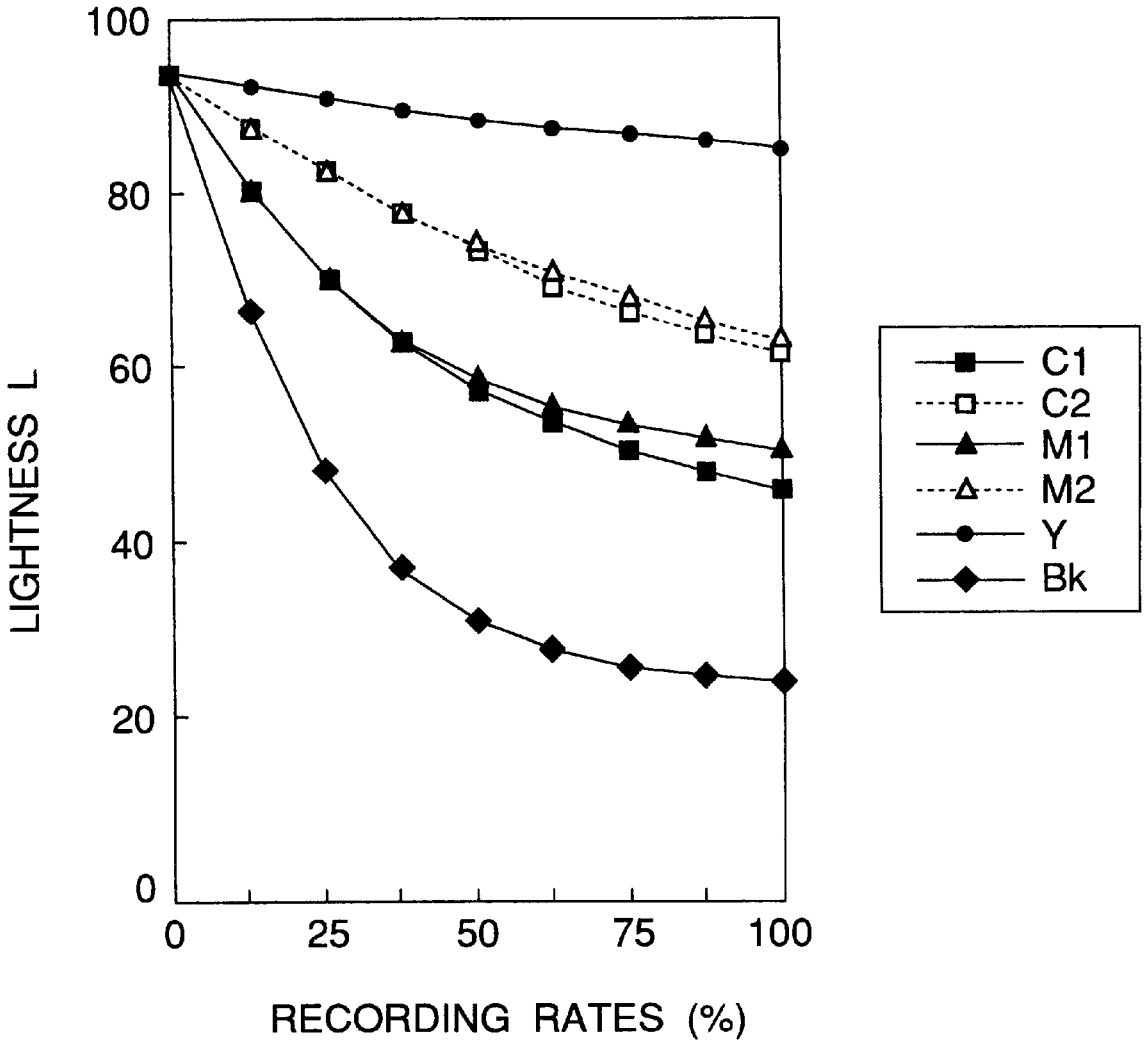
FIG. 17 is a graph showing relationships between the recording rates of the individual color inks and the lightness.

The lightness values of those color inks contained in the color ink cartridge 70*b* were measured and the results of the measurement are shown in FIG. 17. In the graph of FIG. 17, the abscissa represents a recording rate for a recording resolution of the printer. Here, the recording rate means a percentage of dots recorded on a white paper P by ink droplets IP ejected from the nozzle n. 100 of the recording rate means that the entire surface of the paper P is coated with ink droplets IP. In the present embodiment, a concentration of dye of the light cyan ink C2 is ¼ in wt % in the cyan ink C1. The lightness value of the light cyan ink C2 when its recording rate is 100% is equal to that of the cyan ink C1 when its recording rate is approximately 35%. This relation is correspondingly applied to the magenta ink M1 and the light magenta ink M2. The recording rate at which the inks of different color densities are equal in their lightness is determined depending on a degree of beauty of a mixture of colors when the print is performed by using both the inks, and practically it is adjusted to be preferably within the range of 20% to 50%. This relation may be described in terms of a rate of the weight percent of the dyes in both the inks. That is, the relation is substantially equivalent to the adjustment of a weight percent of dye in the inks of low color density (light cyan ink C2 and light magenta ink M2) to be about ⅕ to ⅓ as large as a weight percent of dye in the ink of high color density (cyan ink C1 and magenta ink M1).

Figure 18:
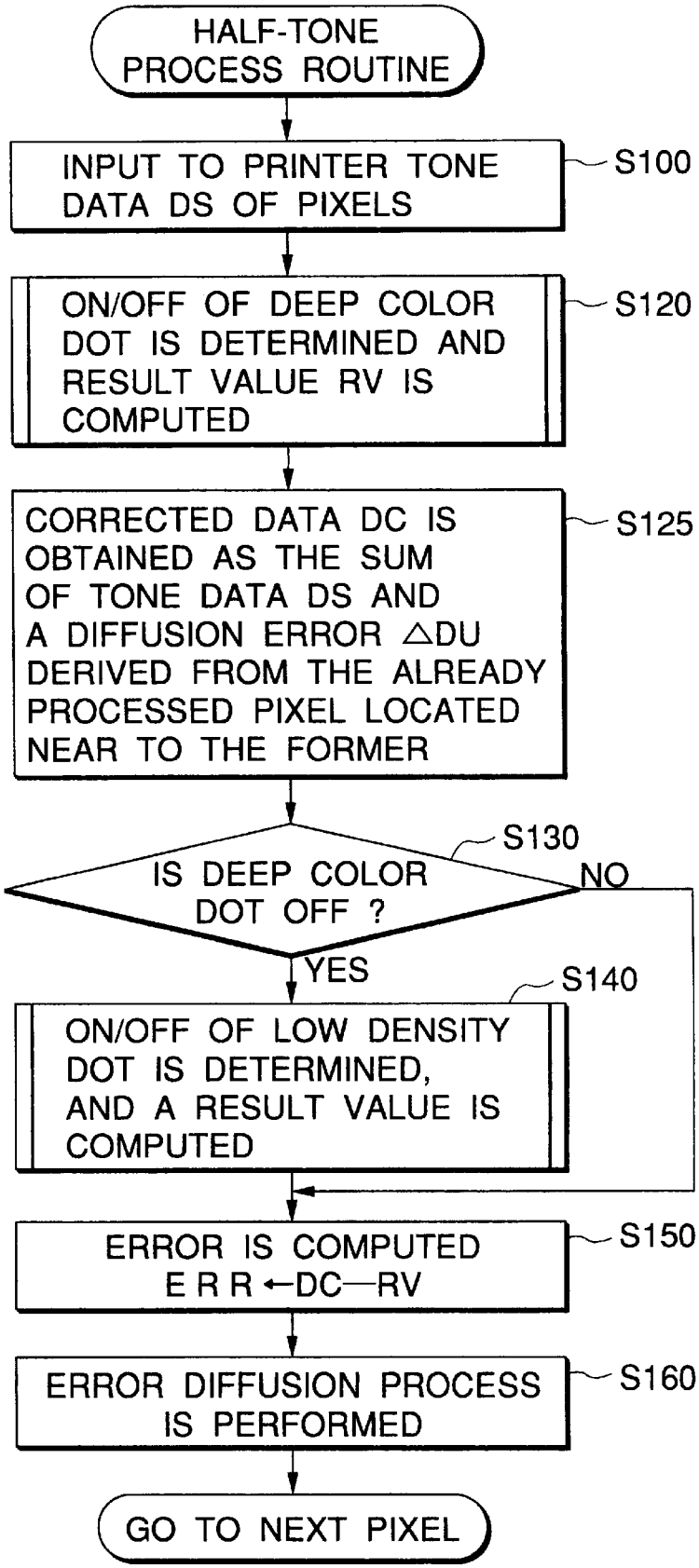
FIG. 18 is a flow chart showing a process carried out by a half-tone module 99.

How the printer 20 to print by using the light and deep color inks will be described in accordance of the procedural steps of a process in the half-tone module 99 of the printer driver 96. FIG. 18 is a flow chart showing an outline of a process of the half-tone module 99. As shown, when the print process starts, the pixels are successively scanned in the order from a pixel at the left upper corner to the subsequent ones in the rightward direction. The color correction module 98 inputs to the printer tone data DS of the pixels already color corrected (each tone data of 8 bits wide for each of the colors C, M, Y and K) in the scanning direction of the carriage (step S100).

The description will be given on the assumption that only the cyan ink is used for the printing, for ease of explanation. Actually, a multi-color print is performed, however. For the color of magenta, deep color dots and light color dots are formed by the high concentration magenta ink M1 and the low concentration light magenta ink M2. For the color of yellow, dots are formed by the yellow ink Y, and for the color of black, dots are formed by the black ink K. When the dots are formed by different color inks in a given area, a control necessary for obtaining a good reproduction of a mixed color, for example, a control so as to prohibit different color dots from being printed at the same position, is carried out.

Figure 19:
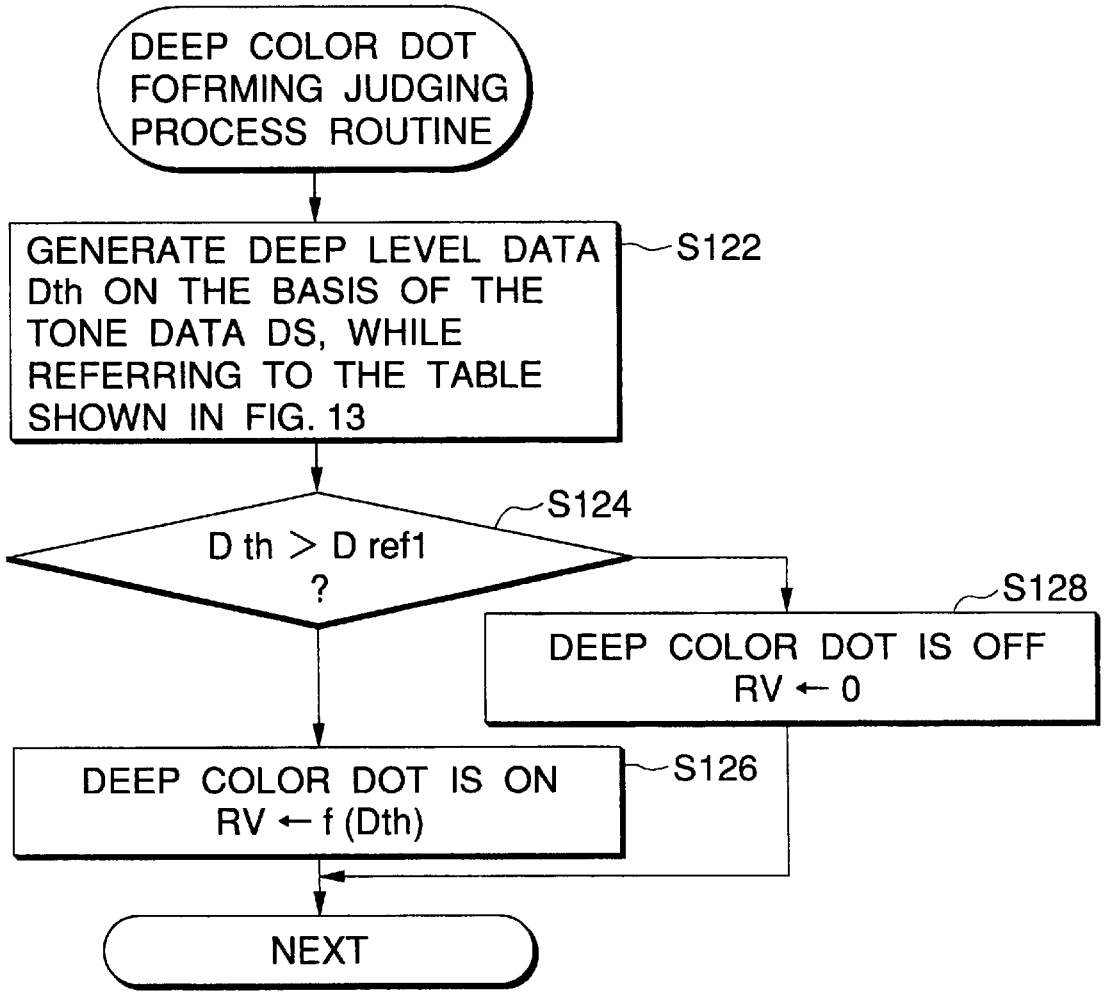
FIG. 19 is a flow chart showing a deep color dot forming judging process routine.
Figure 20:
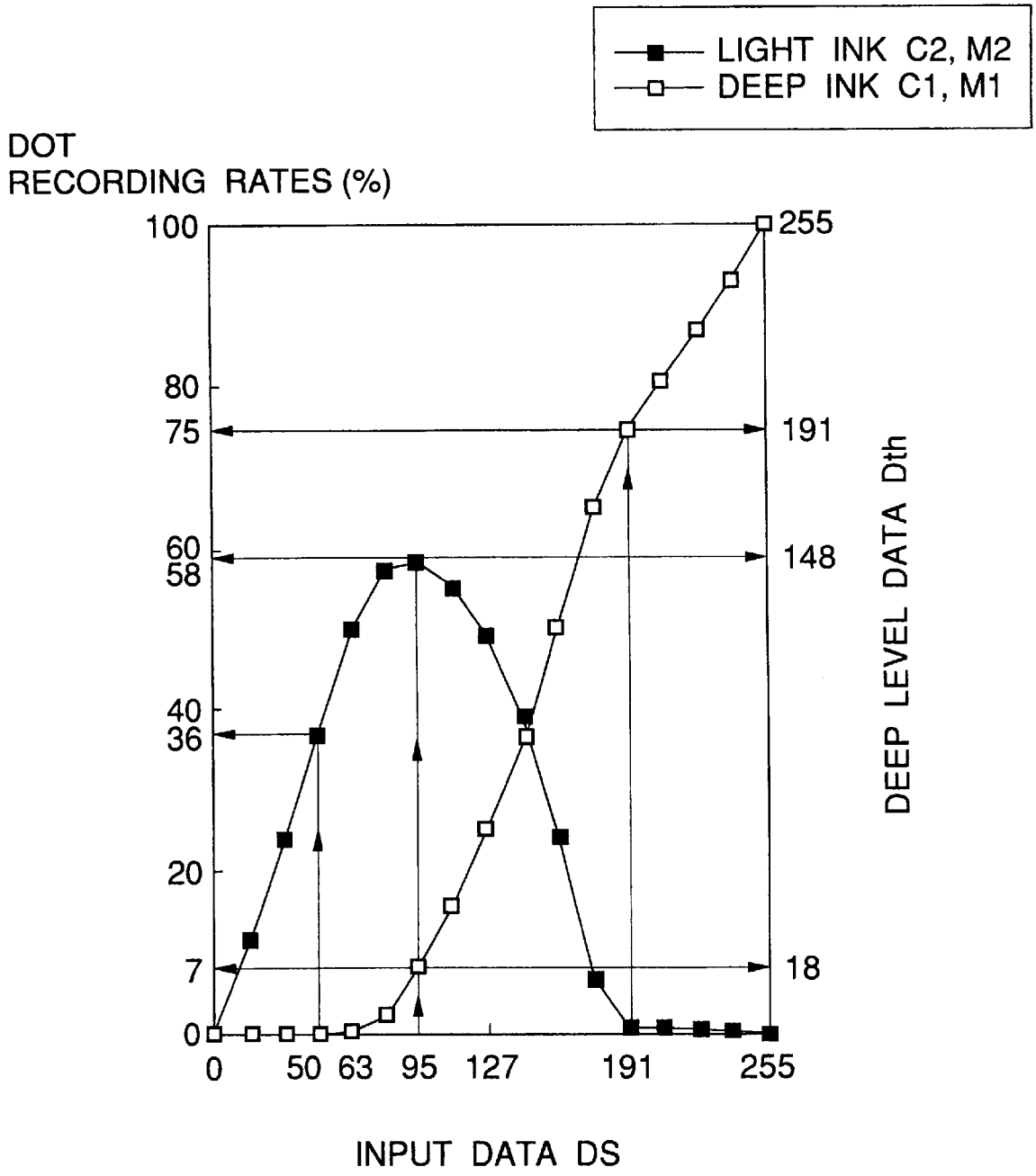
FIG. 20 is a graph showing relationships between the recording rates by light and deep color inks in the present embodiment.
Figure 21:
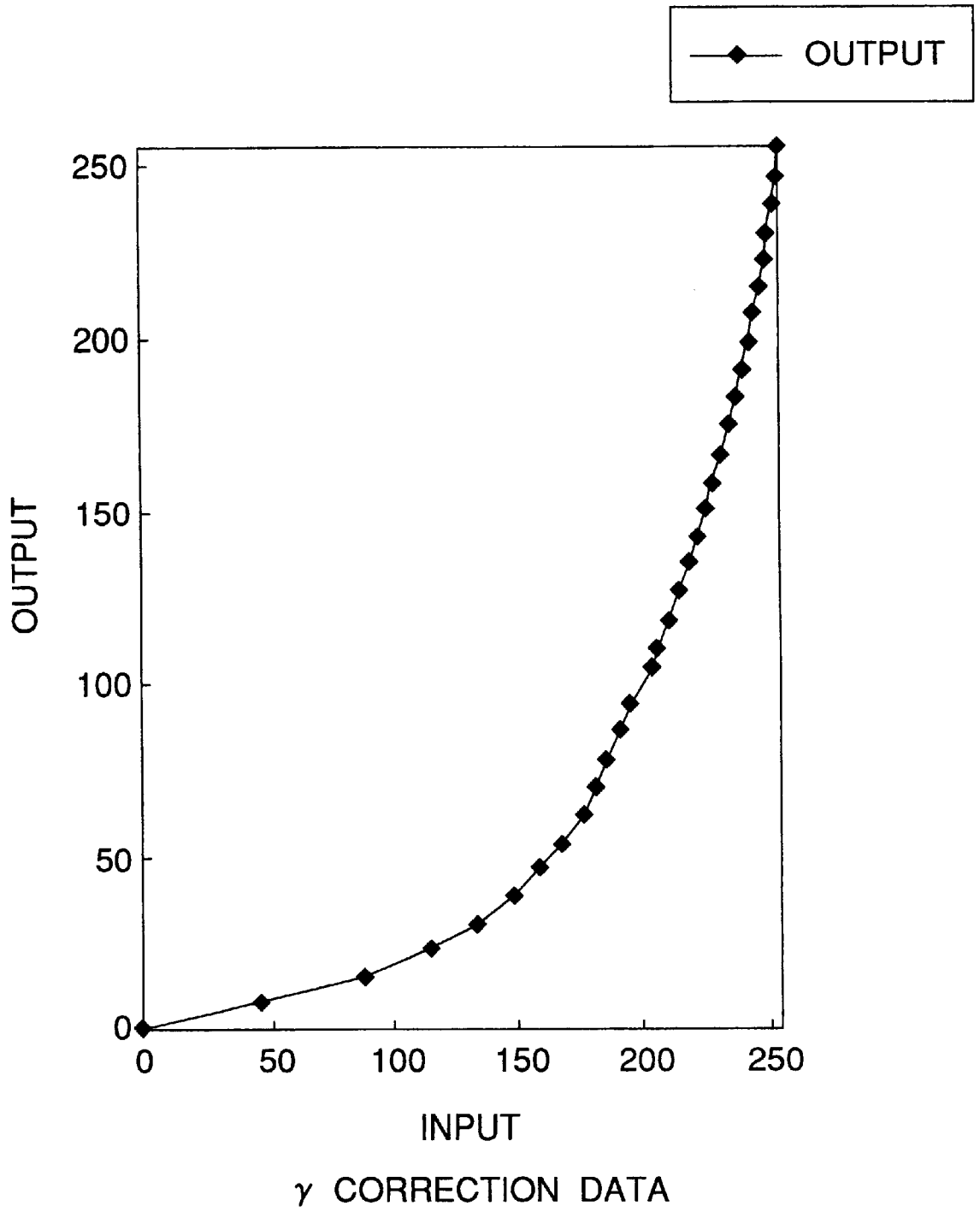
FIG. 21 is a graph exemplarily showing a γ-correction data in the printer 20.
Figure 22:
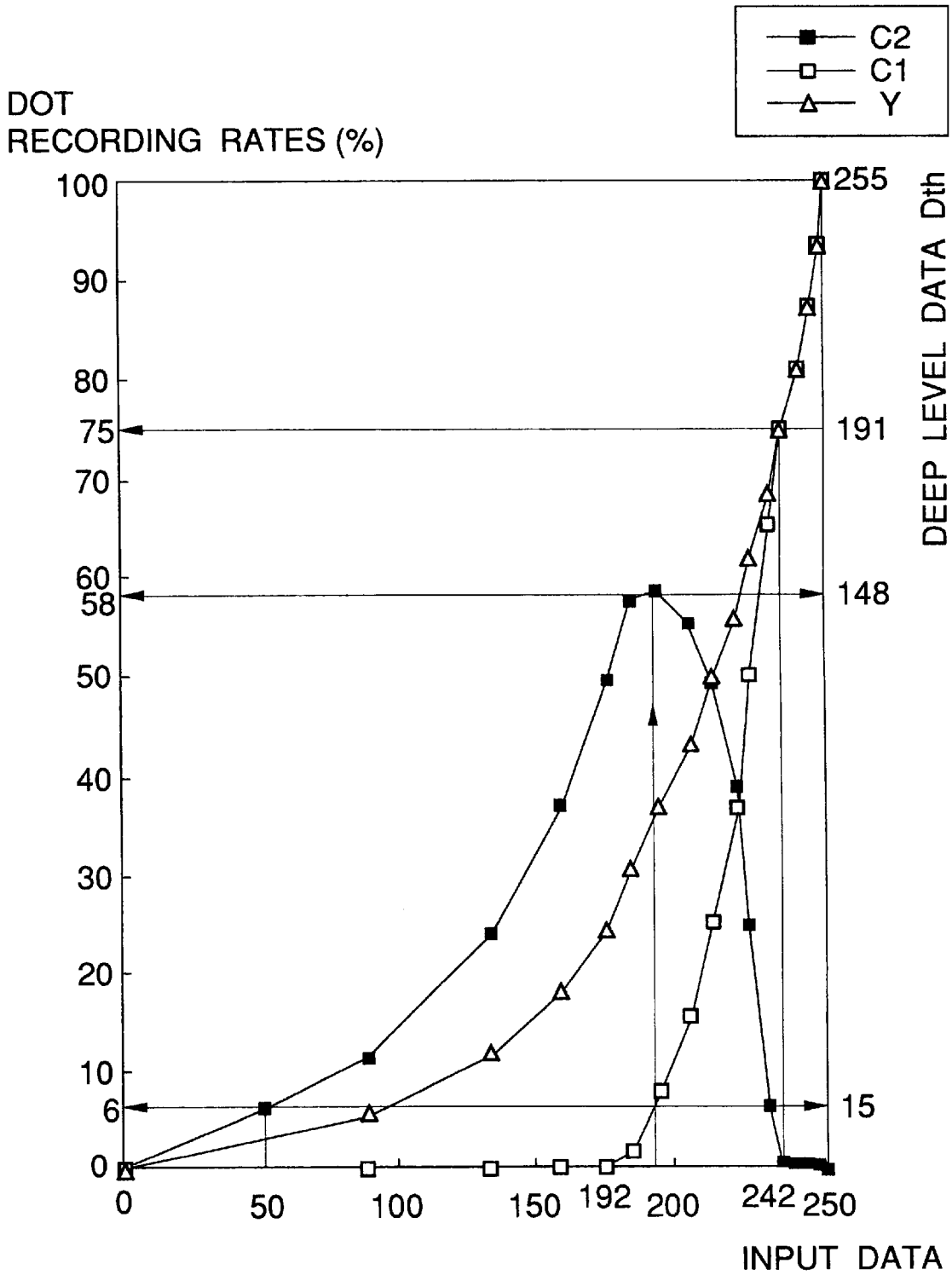
FIG. 22 is a graph showing the relationships between the recording rates after γ-correction and tone data.

A process to determine an on/off of the deep color dot is carried out in accordance with input tone data DS (step S120). Detail of the process to determine the on/off of the deep color dot is shown in FIG. 19 showing a deep color dot forming judging process routine. The routine carries out a process to generate deep level data Dth (step S122) on the basis of the tone data DS, while referring to the table shown in FIG. 16. FIG. 20 is a table used for determining the recording rates of the light color ink and the deep color ink for the tone data of an original image. The tone data takes any of values 0 to 255 for each color (8 bits wide). Therefore, the size of the tone data is expressed as $^{16}/_{255}$, for example. The table of FIG. 20 shows characteristics of the dot recording rates when the input data is perfectly coincident with the print result. In actual printers, a perfect proportional relationship is not present between the input data and the print result since a dot gain of ink (the print result is deeper than the input data because of such factors as ink droplet diameter and a spread of ink) is present. An operation to correct the input/output characteristic is a γ correction. γ correction data of the printer 20 of the present embodiment is shown in FIG. 21. A relationship of the input data vs. dot recording rate obtained when the y correction shown in FIG. 21 is taken into consideration is shown in FIG. 22. FIG. 22 shows a rate of deep color ink and light color ink on a printed matter actually gained.

In the present embodiment, as will be described later, an on/off of the deep color dot is determined by a Dither method, and then an on/off of the light color dot is determined by an error diffusion method. The color dot on/off determining method of the embodiment is not such a method that for tone data, a recording rate of deep color ink and a recording rate of light color ink are uniquely given, and an on/off of the dot by the deep color ink or light color ink for a target pixel is determined. This relation will briefly be described. In the present embodiment, as shown in FIG. 18, an on/off of the deep color dot is first determined by using the table (step S120), and an on/off of the light color dot is then determined while referring to the determining result of the deep color dot (step S140). An on/off of a light color dot is determined on the basis of the following light color dot data Dx. The data Dx is given by $$Dx=Dth\cdot Z/255+Dtn\cdot z/255$$

In the above expression, Dtn is light color dot data obtained from the tone data DS by using the graph of FIG. 20. Z is an evaluation value when the deep color dot is on, and z is an evaluation value when the light color dot is on. Dx is the sum of the values that are obtained by multiplying the evaluation values of the light and deep color dots by weighting coefficients. Thus, the data-to determine the on/off of the light color dot is not the light color dot data but the data Dx resulting from the data of the light and deep color dots. The evaluation value Z when the deep color dot is on, or formed can be considered as the lightness value 255, and then the above expression is rearranged into $$Dx=Dth+Dtn\cdot z/255.$$

The evaluation value z of the light color dot is smaller than the evaluation value Z of the deep color dot. In the present embodiment, z=160.

Let us continue the description on the determining of the on/off of the deep color dot. Deep level data Dth (the ordinate on the right-hand side in FIG. 22) corresponding to a recording rate of a predetermined deep color ink is obtained on the basis of input tone data DS, while referring to the FIG. 18 table. In a case where input cyan tone data prints a sold area of $^{50}/_{256}$, the recording rate of the cyan ink C1 as deep color ink is 0%, and the deep level data is also 0. In a case where tone data prints a solid area of $^{192}/_{256}$, the cyan ink C1 as deep color ink is 6% and the deep level data Dth is 15. In a case where tone data prints a solid area of $^{245}/_{256}$, the cyan ink C1 is 75% and the deep level data Dth is 191. When the on/off of the light color dot is determined by a method to be given later, the recording rates of the light cyan ink C2 as light color ink are 6%, 58% and 0%.

Figure 23:
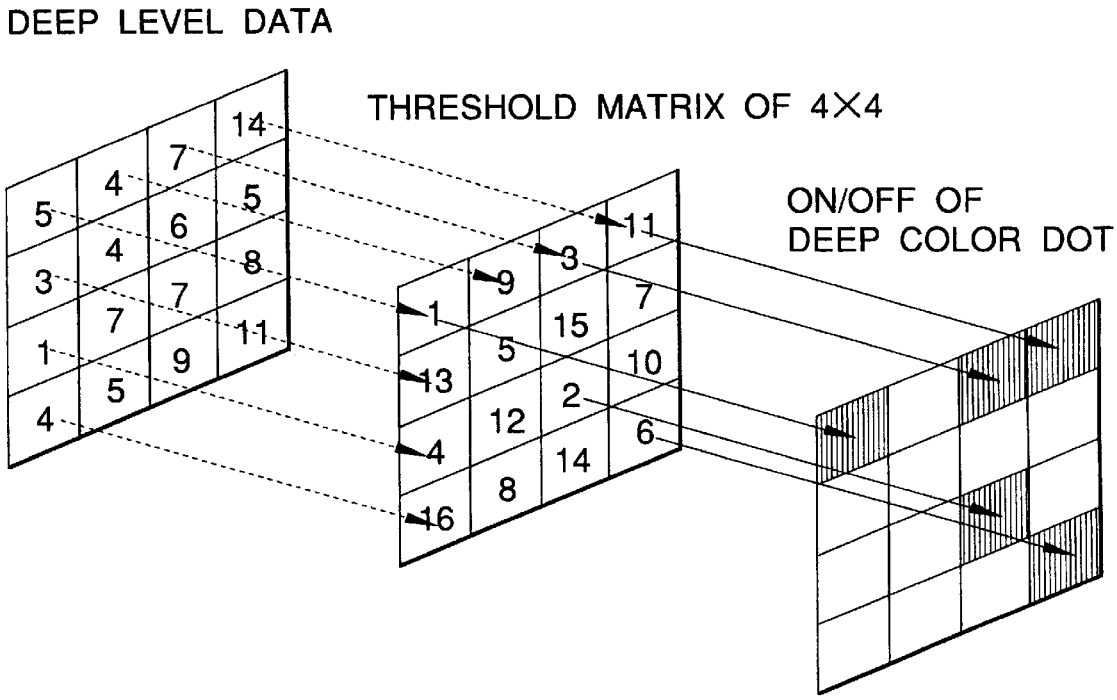
FIG. 23 is a diagram showing a process to determine deep color dots by an ordered dither method.

Whether or not the thus obtained deep level data Dth is larger than a threshold value Dref1 is determined (step S12 in FIG. 19). The threshold value Dref1 is a value indicating whether or not a deep color dot is to be formed at a target pixel, and may simply be set at approximately ½ of the deep level data Dth. In the present embodiment, a threshold matrix of the dispersion type dither is employed to determine this threshold value. Particularly, an ordered dither method is employed using a large matrix (blue noise matrix) of about 64×64. Therefore, the threshold value Dref1 to determine the on/off of the deep color dot is different for each target pixel. The concept of the threshold value in the ordered dither method is shown in FIG. 23. In FIG. 23, a matrix of 4×4 is used for ease of explanation. In the present embodiment, a large matrix of 64×64 is used, and threshold values (0 to 255) are selected so that their occurrence is uniform in any of the regions of 16×16 within the matrix. Use of such a large matrix suppresses the occurrence of a pseudo contour, for example. In the dispersion type dither, a spatial frequency of dots determined by the threshold matrix is high, and dots dispersedly appear within the region. A threshold matrix of the Beyer type, for example, is known for the dispersion type dither. Where the dispersion type dither is used, deep color dots dispersedly appear. Therefore, a distribution of dots over the region is not deviated, improving the image quality. Another suitable method, for example, a density pattern method or a pixel distribution method, may be used to determine the on/off of the deep color dot.

When the deep level data Dth is larger than the threshold value Dref1, it is determined that the deep color dot is to be in an on state, and a process to compute a result value RV is carried out (step S126). The result value RV corresponds to a value (deep color dot evaluation value) corresponding to an optical density of the pixel. When it is determined that the deep color dot is on, that is, a dot by high color density ink is formed on the pixel, a value (e.g., 255) corresponding to the density of the pixel is set. The result value RV may be a fixed value, and if necessary, a function of the deep level data Dth.

When the deep level data Dth is smaller than the threshold value Dref1, it is determined that the deep color dot is off, that is, it is not formed, and 0 is substituted into the result value RV (step S128). In an area where the dot of high color density ink is not formed, a white background of the paper is left. It is for this reason that the result value RV is set to 0.

Figure 24:
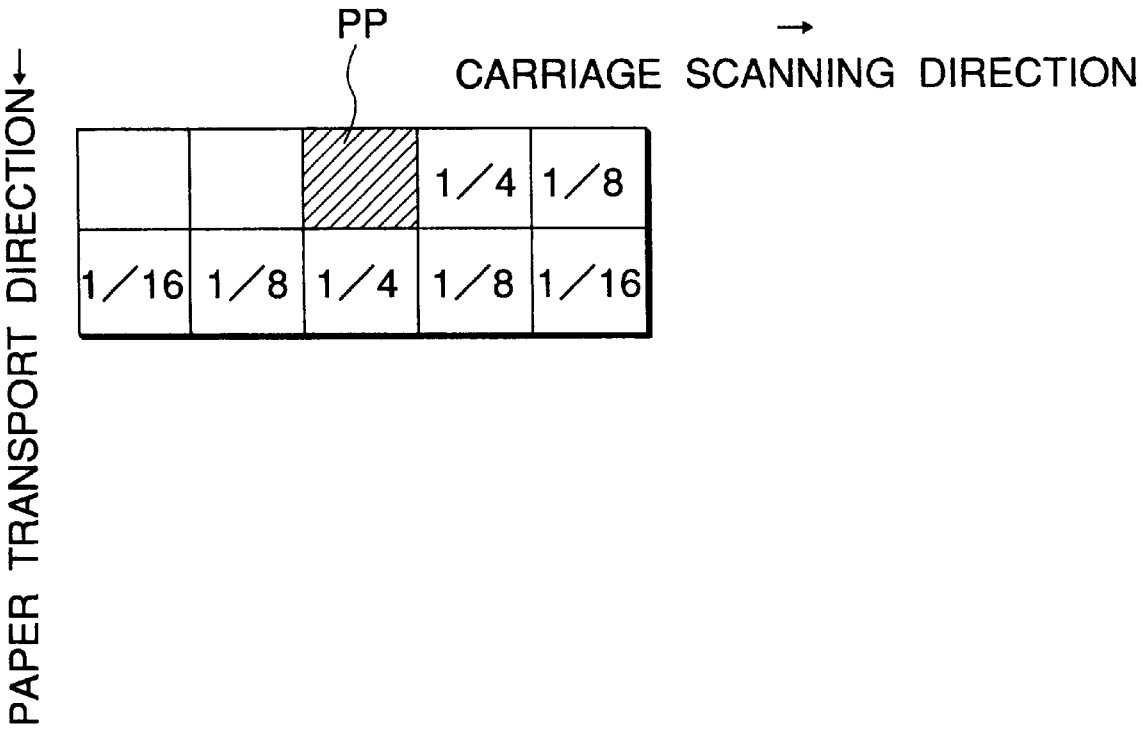
FIG. 24 is a diagram showing how an error is allotted from a dot to its peripheral dots in the error diffusion method.

Following the determining of the on/off of the deep color dot and the process (step S120 in FIG. 18) to compute the result value RV, a process is carried out which obtains corrected data DC as the sum of tone data DS of the current target pixel and a diffusion error ΔDu derived from the already processed pixel located near to the former (step S125). This is done for carrying out a process of an error diffusion by using the light color dot. To perform the printing based on the error diffusion, a related error component is read out and applied to the pixel which will undergo the printing since a color shade error caused in the already processed pixel is weighted and allotted to the pixels located around the processed pixel. How the color shade error is weighted and allotted to the pixels around a target pixel PP is shown in FIG. 24. As shown, given weights (¼, ⅛, 1/16) are applied to the density error, and the weighted ones are allotted to several pixels subsequent to the target pixel PP in the scanning direction of the carriage 30, and several pixels located behind the target pixel PP in the transport direction of the paper P.

Figure 25:
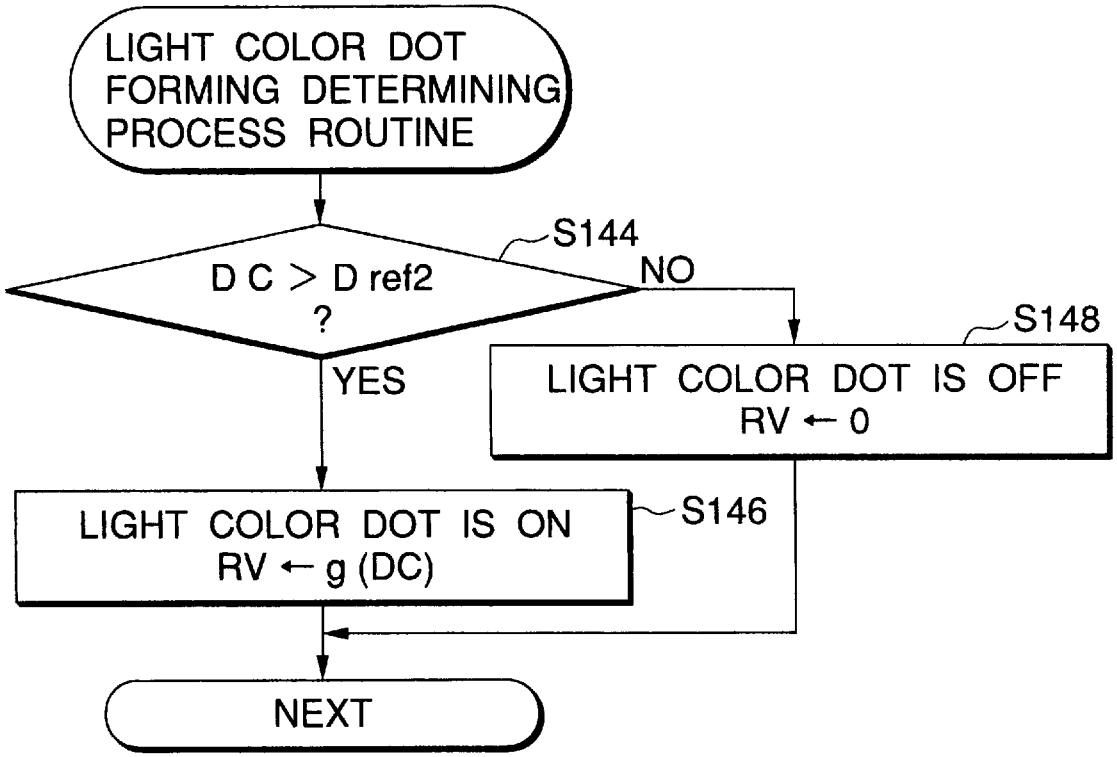
FIG. 25 is a flow chart showing a light color dot forming determining process routine.
Figure 26:
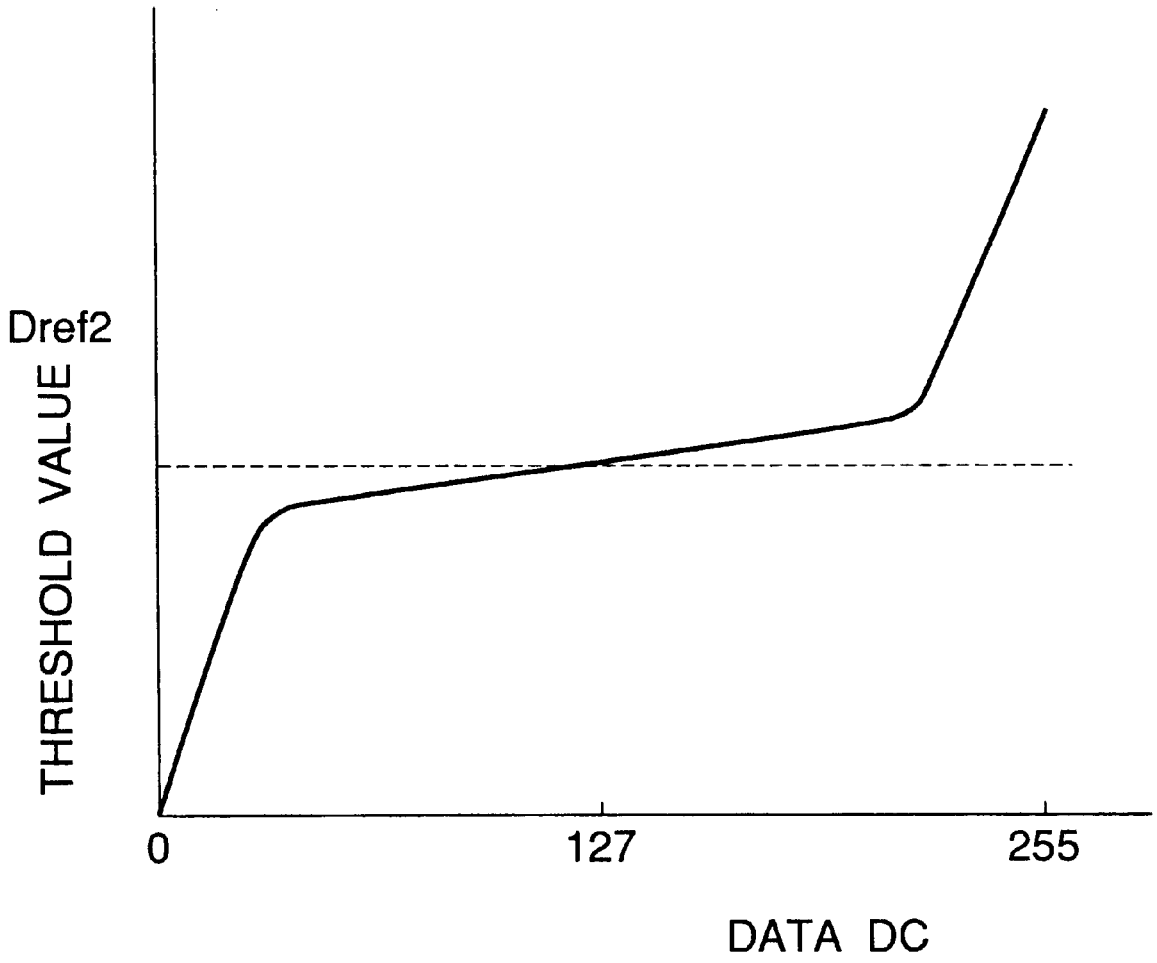
FIG. 26 is a graph showing how a threshold value Dref2 is set to corrected data DC.
Figure 27A:
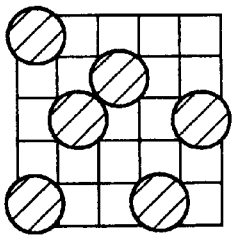
FIGS. 27*a*–27*h* is an explanatory diagram showing a process of forming dots by light and deep color inks.
Figure 27B:
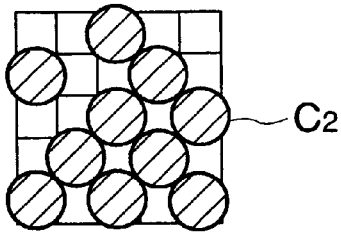
Figure 27C:
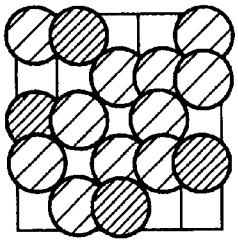
Figure 27D:
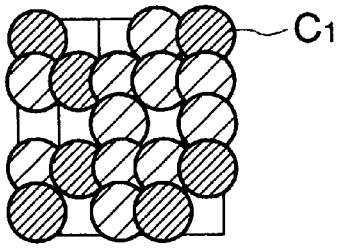
Figure 27E:
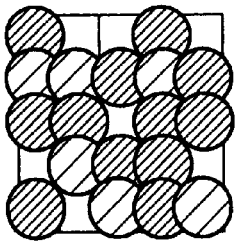
Figure 27F:
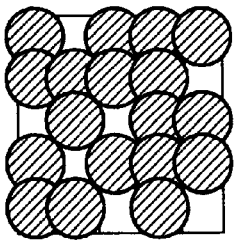
Figure 27G:
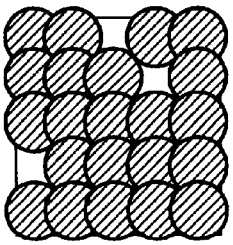
Figure 27H:
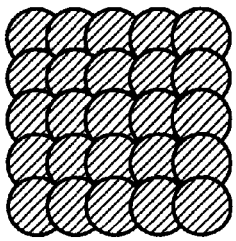

After the corrected data DC is obtained, it is determined whether or not the deep color dot is put in an on state (a dot is formed by the cyan ink C1) (step S130). If the deep color dot is not formed, a process to determine the on/off of a dot of low color density, or a dot by the light cyan ink C2 (referred to a light color dot) (step S140) is carried out. A process to determine the on/off of the light color dot will be described with reference to FIG. 25 showing a light color dot forming determining process routine. In the process to determine the on/off of the light color dot, an error diffusion method is applied to the formation of a dot by the light cyan ink C2 in the embodiment, and it is determined whether the corrected data DC corrected on the basis of the concept of the error diffusion is larger or smaller than a threshold value Dref2 (step S144). The threshold value Dref2 is a value indicating whether or not a light color dot is to be formed at a target pixel, and may simply be fixed, but in the embodiment, it is variable, which is varied in accordance with the corrected data DC. A relationship between the threshold value Dref2 and the corrected data DC is shown in FIG. 26. As shown, the threshold value Dref2 is handled as a function of the corrected data DC to be judged. Such a handling suppresses a delay of the dot formation near the lower or upper limit of a tone, and an irregularity (called a trailing) of a dot formation that will occur in a fixed range in the scanning direction when a tone abruptly changes in an image area.

If the corrected data DC is larger than the threshold value Dref2, it is determined that a light color dot is put in an on state, and a result value RV (light color dot evaluation value) is computed (step S146). For the result value RV, its reference value is set at 122 in the embodiment, and the result value is corrected by the corrected data DC, but may be a fixed value. If the corrected data DC is smaller than the threshold value Dref2, it is determined that the light color dot is put in an off state, and a process to set the result value RV to 0 is carried out. There are many methods to determine the result value RV. In an example of the method, a deep color dot is determined by the deep level data Dth, and a light color dot is determined by using the input tone data DS.

Following the determining of the on/off of the light color dot and the process (step S140 in FIG. 18) to compute the result value RV, a process to compute an error is carried out (step S150). An error is obtained by subtracting the result value RV from the corrected data DC. Where neither the deep color dot nor the light color dot is formed, the result value RV has been set to 0, and the corrected data DC is incorporated into an error ERR. That is, since a density to be achieved for the pixel is not obtained, its density is computed and output as an error. Where the deep color dot or the light color dot is formed, the result value RV corresponding to the dot formed is substituted into it, and a difference between it and the corrected data DC upon which the judgement is made is an error ERR.

An error diffusion process is performed (step S160). The error obtained in the step S150 is diffused by applying given weights (FIG. 24) to the pixels located near the target pixel. After the process thus far described is completed, the process subsequent to the step S100 is applied again to the next pixel.

The light color dot and the deep color dot are recorded in this way. Models of the recording of those dots by the cyan ink C1 and the light cyan ink C2 are illustrated in FIG. 27. In a region where the input tone data is low (the tone data is 0/256 to 175/256 in this embodiment), as shown in FIGS. 27(*a*) and 27(*b*), only dots by the light cyan ink C2 are formed, and the number of the light color dots present within a given region increases as the tone data goes high.

In a region where the tone data exceeds a predetermined value (175/256 or larger in this embodiment), as shown in FIG. 27(*c*), the number of the light color dots increases and the recording of the deep color dot starts and its number gradually increases. In a region where the tone data goes more high (exceeds 192/256 or larger), as shown in FIGS. 27(*d*) and 27(*e*), the number of the deep color dots increases while the number of the light color dots is decreased.

In a region where the tone data goes further high (242/256 or larger), no further formation of the light color dot is performed, and as shown in FIGS. 27(*f*) and 27(*g*), only the deep color dots are formed. When the tone data reaches its maximum value, as shown in FIG. 27(*h*), the recording rate of the deep color dots is 100%, and in this state, the surface of the paper P is entirely printed by the deep color ink (cyan ink C1).

As seen from the foregoing description, in the present embodiment, whether or not a dot by deep color ink is to be formed is first determined, and then a result value RV are determined on the basis of the on/off of the deep color dot. Thereafter, only when it is determined that the deep color dot is not formed, it is determined whether or not a dot by light color ink is formed, and a result value RV is determined on the basis of the on/off of the light color dot. The ordered dither method is used for the judgement on the deep color dot, and the error diffusion method is used for the judgement on the light color dot. As a result, a density of an image to be printed is adjusted so as to minimize an error by the on/off of the light color dot. Further, the judgement on the deep color dot is first made. Because of this, the deep color dots are distributed without giving rise to any unnatural feeling and their distribution is excellent in graduation expression by properly setting the relationship between the input data and the deep level data Dth in the FIG. 20 table.

Also in the embodiment, it is noted that the color ink heads 61 to 66 of the print head 28, i.e., the black ink BK head, cyan ink C1 head, light cyan ink C2 head, magenta ink M1 head, light magenta ink M2 head, and yellow ink Y head, are arranged in this order when viewed in the printing direction. Therefore, the thus ordered print head arrangement brings about the following useful advantages. In the print heads thus arranged, ink that is first ejected and forms a dot on the paper with the movement of the carriage 30 is the black ink (BK), then cyan inks (C1 and C2) and the magenta inks (M1 and M2) are ejected, and finally the yellow ink (Y) is ejected. Color ink later ejected onto the paper spreads into the ink already forming a dot, but the ink that is already ejected and spread into the paper does not spread.

Accordingly, in the present embodiment, a single dot of the cyan ink C1 or the light cyan ink C2 or discrete dots of a color of a family of cyan are formed before the dots of the magenta ink M1 or the light magenta ink M2 are formed. Therefore, it never happens that the ink of a cyan family color spreads into the ink of any of the remaining colors. An expansion of the cyan family color dot, which is loud, is suppressed, and a graininess of the cyan family color dot is lessened. This results in an improvement of a color reproduction on the printed matter. The reason why a graininess of the cyan dot is greater than of the magenta dot and the yellow dot will be estimated as described hereunder.

Figure 28:
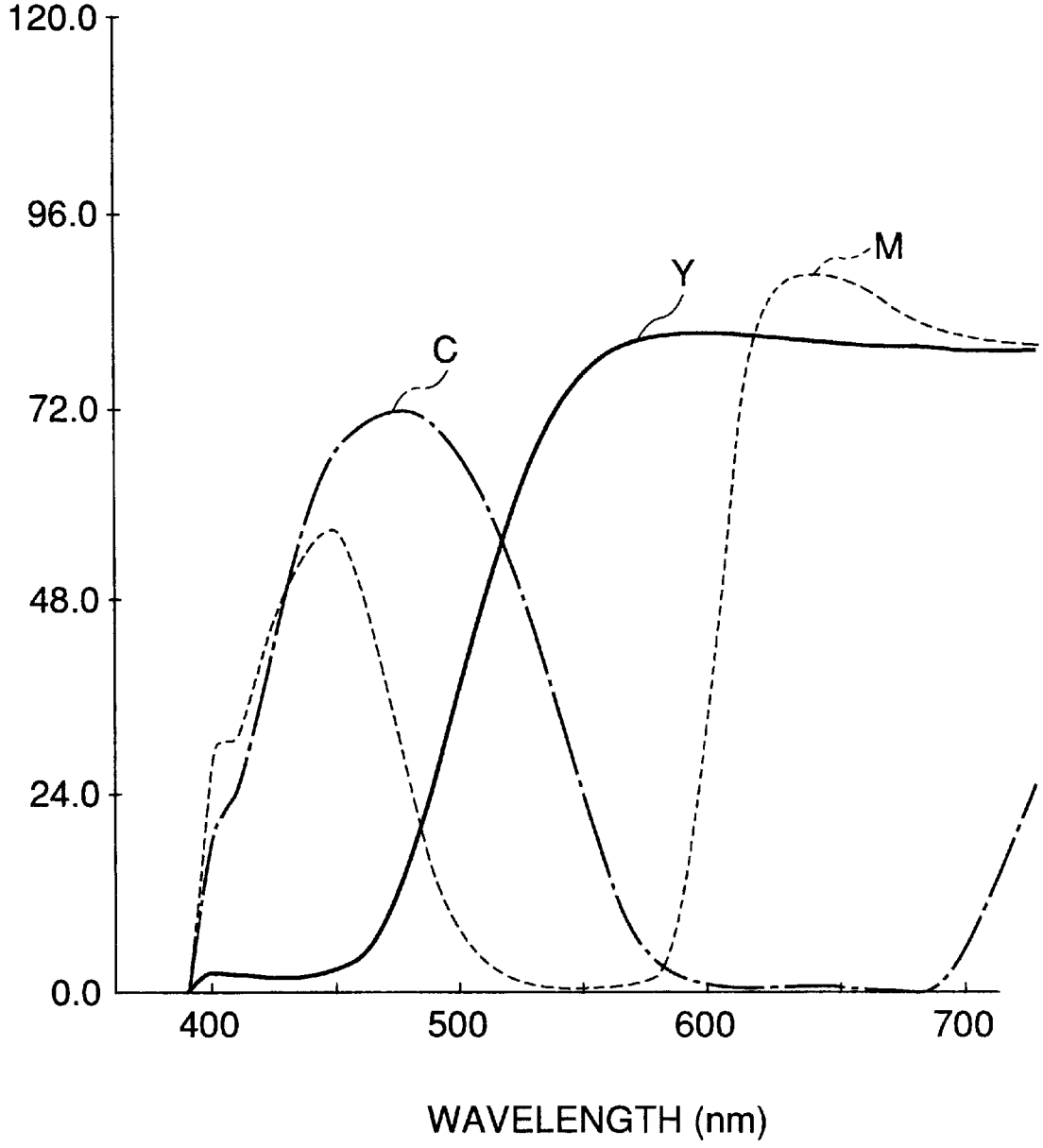
FIG. 28 is a spectral diagram of the color inks.

The spectral characteristics of the coloring materials, such as pigments and dye, that may be used for the color inks of the current ink jet printers, are shown in FIG. 28. Coloring material of yellow having, as shown, a substantially ideal spectral characteristic is commercially available. The magenta coloring material, commercially available, has a spectral characteristic component that is contained in the spectral characteristic of the yellow coloring material. The cyan coloring materials, now marketed, are only those having more unnecessary spectral characteristic components and being close in nature to black coloring materials. When those inks are used, care must be taken when a graininess on the printed matter is reduced.

Figure 29A:
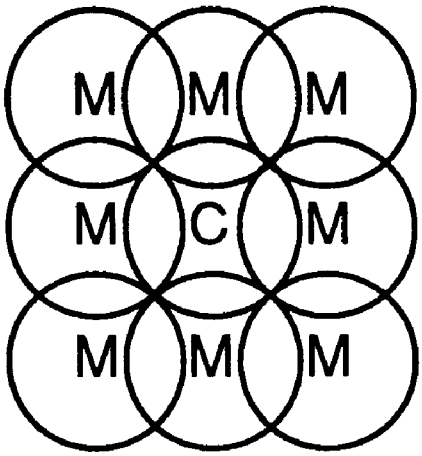
FIGS. 29*a,* 29*b* is a diagram showing print patterns by magenta ink whose graininess becomes problematic and cyan ink.

For this reason, in forming a pattern consisting of a cyan dot C and a plural number of magenta dots M located around the cyan dot C as shown in FIG. 29A, when the magenta dots M are formed after the cyan dot C is formed, the inks of the cyan dots M spread into the cyan dot C that is still wet. The magenta dots M expand their areas, but the cyan dot C that tends to provide a graininess does not spread into the magenta dots M. Therefore, the cyan dot is unobtrusive.

Figure 29B:
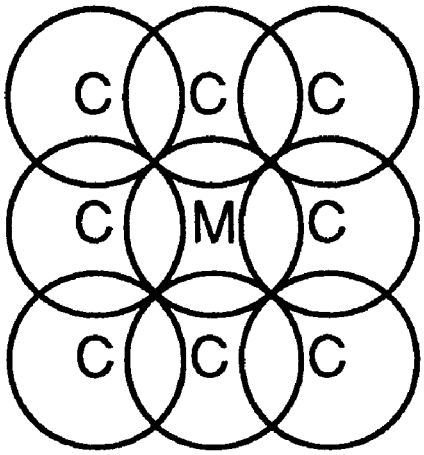
Figure 32A:
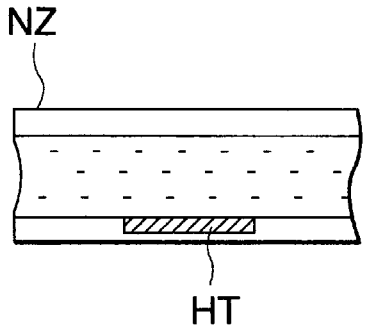
FIGS. 32*a*–32*e* is an explanatory diagram showing another structure of an ink jetting mechanism.
Figure 32B:
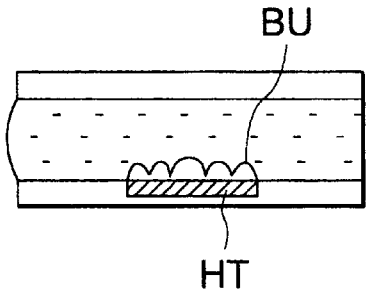
Figure 32C:
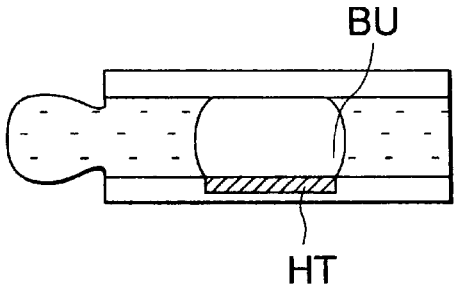
Figure 32D:
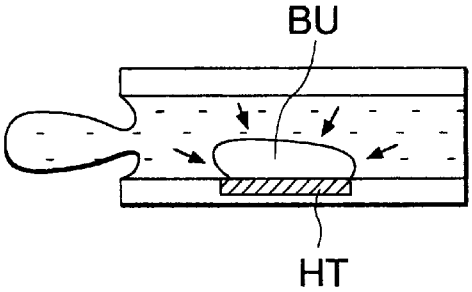
Figure 32E:
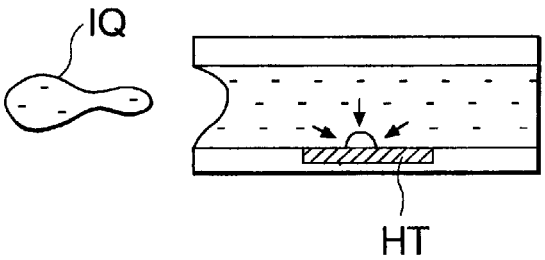

This is well understood when comparing the graininess of the dot patterns shown in FIGS. 29A and 29B which are formed in different cyan and magenta recording orders.

In a state that the inks of dots are still wet, if a dot is formed at a spot surrounded by those dots already formed, the new dot more spreads under influence by the old dots and becomes obtrusive. This tendency is remarkable when the cyan dot that is more obtrusive than the magenta dot spreads.

In case where magenta dots M are formed around a cyan dot C already formed as shown in FIG. 29A, if one cyan dot C is formed and then the magenta dots M are formed around the cyan dot C, the cyan dot C does not spread into the magenta dots M located therearound. In a case where a magenta dot M is formed at a spot surrounded by cyan dots C already formed as shown in FIG. 29B, the magenta dot M spreads out to the cyan dots C that are imperfectly dried. In this case, if the magenta dot M spreads out, it presents a less graininess since the cyan ink is less obtrusive than the magenta ink.

Let us consider a case where the order of the recording of the color dots is reversed, viz., the magenta dot M is first printed and then the cyan dot C is printed. In the FIG. 29A pattern, the cyan dot C spreads out to the magenta dots M already formed therearound under influence of the wet magenta dots M. An area of the cyan dot C expands and the presence of the obtrusive cyan dot C increases, and the cyan dot C is more obtrusive. In the FIG. 29B pattern, the cyan color occupies a large area. If the cyan dot C somewhat expands toward the magenta dot M, the whole area of the cyan dots a little changes. At this time, the area of the magenta dot M does not expand, and hence presents no graininess.

In printing a pattern where a cyan dot is located at the central spot of a plural number of magenta dots, viz., the FIG. 29A pattern, it is essential to prevent the cyan ink C from spreading out to the dots surrounding the former, in order to reduce the graininess. The same thing is true for the combination of the light cyan ink and the light magenta ink.

The combination of two inks, the deep cyan ink C1 and the deep magenta ink M1, were discussed. The graininess can be evaluated by using two patterns of FIGS. 29A and 29B also when four kinds of color inks, or the inks of cyan ink C1, light cyan ink C2, magenta ink M1 and light magenta ink M2, are combined.

Turning now to FIG. 30, there is a table showing the relationships between the color orders that will theoretically exist ("Color Orders Allowing Patterns to Exist" in Table 1) and a degree of graininess ("Graininess Results" in Table 1) when patterns (patterns in FIGS. 29A and 29B) each consisting of a single dot and a plural number of dots surrounding the single dot by using the deep and light cyan inks C1 and C2, and the deep and light magenta inks M1 and M2 are formed.

As stated above, a print pattern having the highest graininess is formed by printing dots by the deep magenta ink M1 and then printing a dot by the deep cyan ink C1 at the spot surrounded by the magenta dots already printed. Such color orders, theoretically estimated, are a pattern of M1, C1, M2, C2 and a pattern of M1, M2, C1, C2 (M1: magenta ink, M2: light magenta ink, C1: cyan ink, and C2: light cyan ink).

In the printing by using two light and deep color inks, two light and deep color inks are always used, and there is no case where only one deep or light color ink is used. In actual printing, the hatched patterns in FIG. 30 ("Patterns Rejected by Signal Processings" in the figure) are not used since the signal processings reject such patterns.

Of the patterns used for printing, the color order whose graininess is considerably high is a No. 5 pattern, which consists of a dot by the light cyan ink C2 and dots by the magenta ink M1 surrounding the cyan ink dot.

In the present embodiment, the dots are formed in the order of the cyan ink C1, light cyan ink C2, magenta ink M1, and light magenta ink M2. Accordingly, a No. 2 pattern is formed in a manner that a single dot by the light cyan ink C2 is first formed, and then dots by the magenta ink M1 are formed. It is possible to prevent the dot by the light cyan ink C2 from spreading out, and to eliminate a graininess of the dot by the light cyan ink C2.

In the present embodiment, as shown in FIG. 16, for those color inks contained in the color ink cartridge 70*b*, the amount vy of the yellow ink (only one kind of yellow ink is used) is related to the amounts vc1, vc2, vm1 and vm2 of light and deep cyan and magenta inks as follows:

$$Vc1<vy<Vc1+vc2, \text{ and } Vm1<vy<vm1+vm2.$$

When a natural picture or a graph painted with different monocolors are actually printed, those color inks are substantially uniformly used. There is no case where one ink is used up earlier than the remaining ones, and the color ink cartridge 70*b* must be replaced with a new one in a state that large amounts of the remaining inks are still left.

Among the amounts of three color inks in the color ink cartridge 70*b*, the following relations hold $$vy \leqq 1.5 \cdot vc1 \text{ and } vy \leqq 1.5 \cdot vm1.$$

Since the amounts of the cartridge or chamber-contained color inks are thus defined, when various pictures about a natural picture are printed, it never happens that one specific ink is used up while sufficient amounts of the remaining inks are still left in the ink cartridge.

The reason for this may be explained by using FIG. 22. FIG. 22 shows variations of the actual recording rates of the different color dots of different densities with respect to input data. Here, it is assumed that a density distribution of an image to be printed is substantially uniform in average at a value between 0 and 255. On this assumption, the amounts of the inks consumed for printing the image to be printed correspond to the results of integrating the variations of the recording rates in the graph. In the printer 20 of the present embodiment, the dot recording rates of the individual inks after γ-correction are set to be low as a whole with respect to the input data. However, it is apparent that the amount of consumed yellow ink Y as the ink of the highest lightness, is much larger than of the cyan ink C1 (vc1<vy). Let us consider the relationship between the total amount of light and deep cyan and magenta inks and the amount of yellow ink. If only the deep magenta or cyan ink is used, it must be only needed that its amount is equal to that of the yellow ink. Actually, the light magenta ink M2 and the light cyan ink C2 are used in a region where the input data is low, however. In this region, the magenta ink M1 or the cyan ink C1 is replaced with the light magenta ink or the cyan ink or the amount of consumed magenta or cyan ink is reduced. When light color ink is used for printing, the amount of ink consumed for obtaining the same color density is increased. Therefore, the total amount of magenta inks, vm1+vm2, is larger than the total amount of yellow ink Y, vy (vy<vm1+vm2, vy<vc1+vc2).

In the present embodiment, the amount of yellow ink contained in the color ink cartridge is 28 g, and the amounts of light and deep magenta and cyan are each 20 g. These figures satisfy the above-mentioned relations:

$$vm1 < vy,\ vc1 < vy$$

$$vy < vm1 + vm2,\ vy < vc1 + vc2$$

$$vy \leq 1.5 \cdot vc1,\ vy \leq 1.5 \cdot vm1.$$

When the amounts of the chamber-contained magenta and cyan inks of low and high densities are thus selected for the amount of chamber-contained yellow ink of the highest lightness, the proper amounts of the chamber-contained inks are obtained without useless consumption of inks.

In the embodiment mentioned above, cyan and magenta inks consumed each consist of two kinds of inks, low and high densities. If these inks each consists three or more kinds of inks, the yellow ink may consist of different kinds of inks. An example of the latter case is tabulated in FIG. 31. As shown, the yellow ink consists of two kinds of inks of low and high densities (normal yellow ink Y1 and light yellow ink Y2). The cyan ink consists of three kinds of inks (high, medium, and light cyan inks C1, C2 and C3). The magenta ink also consists of three kinds of inks (magenta inks M1, M2 and M3 of high, medium, and low color densities). As seen from the table, the amounts of those color inks are mathematically given by $$vy1 + vy2 < vm1 + vm2 + vm3$$

$$vy1 + vy2 < vc1 + vc2 + vc3$$

$$vm1 < vy1 < vm1 + vm2 \text{ and } vc1 < vy1 < vc1 + vc2$$

$$vm2 < vy2 < vm2 + vm3 \text{ and } vc2 < vy2 < vc2 + vc3$$

$$vy1 \leq 1.5 \cdot vm1 \text{ and } vy1 \leq 1.5 \cdot vc1$$

$$vy2 \leq 1.5 \cdot vm2 \text{ and } vy2 \leq 1.5 \cdot vc2$$

Also in this case, the amounts of those color inks consumed for the input data of a normal image are substantially equal, and unnecessary waste of inks is minimized.

In the light of the amounts of the cartridge or chamber-contained inks, those inks may be contained in various manners. Those inks may be contained in a single ink cartridge 70 as shown in FIG. 5. The high and low color density inks may be contained for each color in a container. The color inks may be contained for each color density in one ink cartridge. The color inks may be contained in ink cartridges, respectively. The colors of the color inks are not limited to C, M, Y and K colors, but may be any other suitable color combination. For special colors, for example, gold and metal, two or more kinds of color inks of different densities may be used. In this case, the amounts of the chamber-contained color inks are determined so that the amount of color ink of the highest lightness and the amounts of other color inks satisfy the above-mentioned relations.

When the color density of the color ink is different every color, it is desirable to convert these different color densities into a color density and to use the above-mentioned ink-amount determining method in determining the amounts of the chamber-contained color inks. The yellow ink has a large lightness value than the cyan and magenta, and a little suffers from the graininess problem. Therefore, the color density of the yellow is selected to be higher than that of each of the remaining ones, cyan and magenta. In this case, since the amount of consumed yellow ink may be reduced, it is necessary to determine the amount of chamber-contained yellow ink, allowing for a deviation of the color density. In a case where a color density of the yellow ink is α% higher than of the remaining ones, and a consumption of the yellow ink is reduced by decreasing the recording rate of the yellow ink by an amount corresponding to α%, the amount vm1 of the chamber-contained magenta ink, the amount vm2 of the chamber-contained light magenta, the amount vc1 of the chamber-contained cyan ink, the amount vc2 of the chamber-contained light cyan ink, and the amount vy of the chamber-contained yellow ink are defined by $$(1+\alpha/100) \cdot vy < vc1 + vc2,$$

and $$(1+\alpha/100) \cdot vy < vm1 + vm2$$

Further, $$vc1<(1+\alpha/100)\cdot vy,$$

and $$vm1<(1+\alpha/100)\cdot vy.$$

Furthermore, it is preferable that the following relations hold $$(1+\alpha/100)\cdot vy\leqq 1.5\cdot vc1,$$

and $$(1+\alpha/100)\cdot vy\leqq 1.5\cdot vm1.$$

While the constructions and operations of the ink cartridge and the printer constructed according to the present invention have been described at various angles, it should be understood that the present invention is not limited to those embodiments but may variously be changed, modified, and altered within the scope and spirits of the appended claims. In the embodiments, for ejecting both high and low color density inks, the piezoelectric elements PE are used and voltages of given widths are applied to the piezoelectric elements PE. Any of other suitable ink jetting systems may be used, as a matter of course. The ink jetting systems currently available may be categorized into an ink jetting system in which ink droplets are separated from a continuous stream of ink, and an on-demand system, employed in the above-mentioned embodiments. The first ink jetting system includes a charging modulation system in which ink droplets are separated from a jet stream of ink by a charging modulation, and a micro-dot system which uses for printing fine satellite droplets generated when ink droplets of large diameters are separated from the ink jet stream. These systems may be applied to the printing device of the invention which uses color inks of different color densities.

In addition to the ink jetting system using the piezoelectric elements, the on-demand system further includes an ink jetting system as shown in FIGS. 32A to 32E. In this system, heating elements HT are located near the ink nozzles NZ. Ink bubbles BU are generated by heating ink by the heating elements HT. Pressure caused at the ink bubble generation is utilized for ejecting ink droplets IQ. The on-demand ink jetting system may also be applied to the printing device of the invention which uses plural kinds of color inks.

What is claimed is:

1. An ink cartridge containing differently colored inks for a printer, comprising:

a plurality of exterior walls defining a body having an interior and including a first wall;

a plurality of partitions joined to and extending from the first wall to define a plurality of ink chambers within the interior of said cartridge, each defining an inner volume configured to and separately storing inks of different colors, one ink chamber of the plurality of ink chambers having a different volume than the remaining ink chambers of the plurality of ink chambers; and a plurality of ink supply ports extending through the first wall, each of the plurality of ink supply ports separately in fluid communication with one of the plurality of ink chambers, the plurality of ink supply ports being equidistantly spaced and arranged in a straight line;

wherein each of said ink supply ports includes an elastically deformable sealing member having a cylindrical fitting portion engaged with an inner surface of each of said ink supply ports, a thin, cylindrical flexible portion extending from and in part substantially parallel to said fitting portion toward said ink chamber associated therewith to define a channel between said flexible portion and said fitting portion, a first tapered guide surface formed below said channel between said fitting portion and said flexible portion and sloping inwardly toward said flexible portion, and a ring-like fitting portion extending from said flexible portion, said first tapered guide surface constructed and arranged to guide an ink supply needle toward the ink chamber and said ring-like fitting portion constructed and arranged to form a liquid-tight seal with said ink supply needle.

2. The ink cartridge according to claim 1, wherein the ring-like fitting portion includes a second tapered guide surface that extends from said flexible portion toward said ink chamber for guiding said ink supply needle.

3. An ink cartridge containing inks for a printer, comprising:

a body having a bottom wall and defining a plurality of ink chambers containing a plurality of inks, said plurality of ink chambers being integrally formed as one unit, and at least two of the plurality of ink chambers having different volumes;

a plurality of ink supply ports extending through the bottom wall, each of the plurality of ink supply ports separately being in fluid communication with one of the plurality of ink chambers, the plurality of ink supply ports being equidistantly spaced and arranged in a straight line, each of said ink supply ports includes an elastically deformable sealing member having a cylindrical fitting portion engaged with an inner surface of each of said ink supply ports, a thin, cylindrical flexible portion extending from and in part substantially parallel to said fitting portion toward said ink chamber associated therewith to define a channel between said flexible portion and said fitting portion, a first tapered guide surface formed below said channel between said fitting portion and said flexible portion and sloping inwardly toward said flexible portion, and a ring-like fitting portion extending from said flexible portion, said first tapered guide surface constructed and arranged to guide an ink supply needle toward the ink chamber and said ring-like fitting portion constructed and arranged to form a liquid-tight seal with said ink supply needle.

4. The ink cartridge according to claim 3, wherein the bottom wall includes an inner surface, and comprising at least two ribs formed on the inner surface of the bottom wall, the ink supply port being disposed between the at least two ribs.

5. An ink cartridge containing ink for a printer, comprising:

an ink chamber for containing ink, said ink chamber having a bottom wall and an inner space;

an ink supply port extending through the bottom wall and being in fluid communication with the ink chamber;

an elastically deformable sealing member having a cylindrical fitting portion engaged with an inner surface of said ink supply port, a thin, cylindrical flexible portion extending from and in part substantially parallel to said fitting portion toward said ink chamber associated therewith to define a channel between said flexible portion and said fitting portion, a first tapered guide surface formed below said channel between said fitting portion and said flexible portion and sloping inwardly toward said flexible portion, and a ring-like fitting portion extending from said flexible portion, said first tapered guide surface constructed and arranged to guide an ink supply needle toward the ink chamber and said ring-like fitting portion constructed and arranged to form a liquid-tight seal with said ink supply needle.

6. The ink cartridge according to claim 5, wherein the bottom wall includes an inner surface, and comprising at least two ribs formed on the inner surface of the bottom wall, the ink supply port being disposed between at least two ribs.

* * * * *